US007041069B2

(12) United States Patent
West

(10) Patent No.: US 7,041,069 B2
(45) Date of Patent: May 9, 2006

(54) POWERED GAIT ORTHOSIS AND METHOD OF UTILIZING SAME

(75) Inventor: R. Gary West, Birmingham, AL (US)

(73) Assignee: Health South Corporation, Birmingham, AL (US)

( * ) Notice: Subject to any disclaimer, the term of this patent is extended or adjusted under 35 U.S.C. 154(b) by 23 days.

(21) Appl. No.: 10/200,453

(22) Filed: Jul. 23, 2002

(65) Prior Publication Data

US 2004/0019304 A1 Jan. 29, 2004

(51) Int. Cl.
*A61H 1/00* (2006.01)
*A61H 1/02* (2006.01)
*A61H 3/00* (2006.01)

(52) U.S. Cl. ..... 601/5; 601/35

(58) Field of Classification Search ..... 482/54, 482/69, 66; 601/23, 33, 35; 434/255, 307 R; 602/36, 23; 607/49
See application file for complete search history.

(56) References Cited

U.S. PATENT DOCUMENTS

| | | | |
|---|---|---|---|
| 4,907,571 | A | 3/1990 | Futakami |
| 4,973,044 | A | 11/1990 | Jones |
| 5,020,790 | A | 6/1991 | Beard et al. |
| 5,190,507 | A | 3/1993 | Iijiima |
| 5,273,502 | A | 12/1993 | Kelsey et al. |
| 5,466,213 | A | 11/1995 | Hogan et al. |
| 5,502,851 | A | 4/1996 | Costello |
| 5,569,129 | A | 10/1996 | Seif-Naraghi et al. |
| 5,662,560 | A | 9/1997 | Svendsen et al. |
| 5,667,461 | A | 9/1997 | Hall |
| 5,695,432 | A | 12/1997 | Söderlund |
| 5,704,881 | A | 1/1998 | Dudley |
| 5,748,845 | A | 5/1998 | Labun et al. |
| 5,795,269 | A | 8/1998 | Bawtree et al. |
| 5,830,162 | A | 11/1998 | Giovannetti |
| 5,865,770 | A | 2/1999 | Schectman |
| 5,961,541 | A | 10/1999 | Ferrati |
| 5,997,444 | A | 12/1999 | McBride |
| 6,231,527 | B1 | 5/2001 | Sol |

FOREIGN PATENT DOCUMENTS

WO WO 00/28927 * 5/2000

OTHER PUBLICATIONS

G. Colombo et al., "Treadmill Training of Paraplegic Patients Using a Robotic Orthosis" in J. of Rehabilitation R&D, vol. 37, No. 6, Nov./Dec. 2000.

* cited by examiner

*Primary Examiner*—Danton DeMille
(74) *Attorney, Agent, or Firm*—Bradley Arant Rose & White, LLP

(57) ABSTRACT

A powered gait orthosis is provided for exercising the legs of a patient, and includes a treadmill for acting on the feet of the patient and a pair of gait simulation assemblies disposed adjacent to the treadmill. Each gait simulation assembly includes a support arm including pivotally movable first and second depending arms, which further include drive means for movement thereof about first and second horizontal axis. The device further includes first and second attachment means on the first and second depending arms, for attachment to a patient's thigh and ankle, respectively. A lifting means including a drive means is supported in a vertically extending tower, which houses a gait simulation assembly. The lifting means lifts and holds a patient on the treadmill. Control means is provided to operate the depending arms in a controlled manner to cause the legs of the patient to move in a desired gait.

62 Claims, 11 Drawing Sheets

552
554
556
558
560
562
564
566
568
570
572
574
576
578
580
582
584
586
588
590
592
59
400
400'
342
342'
188
4
40
42
65
318
136
86
88
32
30
290
351
372
424
38
49
56
52
62
64
60
46

46
38
48
49
49
60
60
54
54
44
188
188
42
42
30
290
290
318
318
136
9
9
7
7
65
65
70
34
32
36
64
64

254
308
318
292
290
304
300
306
11
310
296
351
256
372

324
332
330
326
322
328
320
338
334
340
336
294
316

312
314
328
294
310
330
322
338
316
320
326
334
324
336
340
332
296
304
308
424

354
392
366
460
394
379
458
456
374
452
408
376
410
396
351
412
450
416
469
468
472
474
426
464
428
466
487
480
494
492
496
482
524
488
500
504
526
478
486
490
19
502
454
518
510
516
506
512
514
508
522
520
528
484
470
20

POWERED GAIT ORTHOSIS AND METHOD OF UTILIZING SAME

BACKGROUND OF INVENTION a. Field of Invention

The present invention relates to a powered gait orthosis, and more particularly to a device to aid in research and rehabilitation of non-ambulatory patients and provide therapeutic exercise for those with spinal cord injuries, neurological impairments and those recovering from orthopedic procedures. The invention also enables the measurement of outcomes and records patient session data for progress analysis. The device causes the legs of a patient to move in a desired gait.

b. Description of Related Art

Prior art devices for similar purposes are often not of sanitary construction and may require special electrical power sources and excessive site preparation. Additionally, such devices may be difficult to ship and setup. The prior art devices often require the presence of more than one trained operator, thereby increasing the cost of such therapy. Additionally, therapists often perform portions of the therapy manually, which does not result in uniform reproducible therapy to the patient. Prior art devices do not always provide easy patient access, and the devices may not successfully simulate a natural walking motion in the patient's legs.

A powered gait orthosis, which overcomes the drawbacks and disadvantages of the prior art devices, was disclosed in pending U.S. application Ser. No. 09/938,825, filed Aug. 27, 2001, the disclosure of which is incorporated herein by reference.

For the invention disclosed in U.S. application Ser. No. 09/938,825, the lifting means employed a large rigid framework having rails along which a trolley is moved and selectively locked in operative position. This arrangement was excessively cumbersome and complex in construction.

SUMMARY OF THE INVENTION

The present invention seeks to overcome the drawbacks and disadvantages of the above-identified prior art devices and provides an improved powered gait orthosis that is simpler and more compact. The present invention is provided with a load cell to accurately continuously measure the weight of a patient supported on a lifting means. In addition, the lifting means includes a harness support which is adapted to swivel into different operative positions and can be locked in a particular orientation with respect to the remaining structure.

The present invention employs a locking mechanism for the movable horizontal arms thereof which is much easier to operate than that disclosed in U.S. application Ser. No. 09/938,825. The drive mechanisms for the first and second depending arms are simpler than those disclosed in U.S. application Ser. No. 09/938,825, and are mounted closer to the depending arms to substantially reduce the distances through which the drive must be transmitted.

Both the thigh attachment means and the ankle attachment means of the present invention include support members which float along guide rods, and the attachment cuffs for the thigh and ankle of a patient are swiveled to the associated support members.

When using the present invention, a patient is initially fitted with a special harness and is lifted from a wheelchair by the lifting means to a standing position with both feet on the treadmill, and the weight of the patient is continuously measured. The attachment cuffs are then attached to one or both legs of the patient. The percent of supported body weight can be adjusted as required as muscle strength of the patient develops. All component speeds are synchronized and controlled by operator input with treadmill speeds ranging from 0 to 5 mph, for example. During a session, information such as heart rate, blood oxygen content, treadmill speed, session duration, etc. can be displayed and recorded for further analysis.

Specifically, the present invention provides a powered gait orthosis including a treadmill for acting on the feet of a patient. The treadmill has opposite sides and a drive means for driving the treadmill. A pair of spaced leg actuator assemblies are disposed adjacent to the opposite sides of the treadmill. Each of the leg actuator assemblies includes a support arm. A first depending arm is supported by the support arm for pivotal movement about a first generally horizontal axis and a second depending arm is supported by the first depending arm for pivotal movement about a second generally horizontal axis. Depending arm drive means are provided for moving the first and second depending arms about the pivot axes thereof. A first attachment means is provided for attaching the first depending arm to a patient's leg just above the knee of the patient's leg. A second attachment means is provided for attaching the second depending arm to a patient's leg adjacent the ankle of the patient's leg. Lifting means is provided for securing to a lifting harness attached to a patient and is supported in a vertically extending tower which houses components of the powered gait orthosis, and is generally vertically movable relative to the treadmill of the powered gait orthosis. Drive means is provided for driving the lifting means generally vertically and control means is connected to the drive means for the treadmill and the drive means for the first and second depending arms to direct the various drive means connected thereto to operate in a coordinated manner to cause the legs of a patient to move in a desired gait.

For the powered gait orthosis described above, the treadmill is interconnected to the leg actuator assemblies. The support arms are disposed substantially horizontally and mounted for swinging movement about a vertical axis so as to swing outwardly away from the treadmill. A lock mechanism is provided for locking the support arm in an operative position, and includes a block mounted adjacent the support arm and has a hole therein. A manually operable handle is mounted to the support arm and connected for reciprocating a bolt between locked and unlocked positions. In the locked position, the bolt is partially disposed within the hole, and in the unlocked position, the bolt is disposed out of the hole. The handle is mounted on a handle shaft disposed perpendicularly adjacent a longitudinal axis of the bolt. The handle shaft is operably connected to the bolt by an arm at a first end thereof. The arm has at least two recesses on a second end. The lock mechanism further includes a biased detent for snap fitting into one of the recesses. In the locked position, the detent is disposed in one of the recesses, and in the unlocked position, the detent is disposed in another one of the recesses. The first end of the arm is bifurcated. The bolt further includes a pin extending substantially perpendicular to a longitudinal axis thereof, and the pin is disposed in the bifurcated end of the arm.

For the powered gait orthosis described above, a drive means is disposed in each of the leg actuator assemblies for providing generally vertical translation for each of the support arms. Each drive means includes a motor drivingly connected to a lead screw engaged with the support arm by a bushing to thereby convert rotational movement of the lead screw into generally vertical translation of the support arm. At least one guide tube is disposed within each of the leg actuator assemblies and extend through holes in the support arm for providing a guide means for guiding generally vertical translation of the support arm. The generally vertical translation of each support arm is limited by a limit switch mounted adjacent opposite ends of the lead screw.

For the powered gait orthosis described above, the drive means for moving the first depending arm of each leg actuator assembly includes a motor supported by the support arm of the associated leg actuator assembly. The motor is interconnected by a belt with a pulley drivingly connected to the first depending arm. The pulley includes a plurality of outwardly projecting teeth matingly engaged with inwardly projecting teeth on the belt. The pulley is connected to a shaft defining the first generally horizontal axis by a key so as to transmit rotational motion to the first depending arm. The first depending arm is retained in position on the shaft by at least one lock nut. A sensor is provided for sensing a target mounted on the pulley and is adapted to sense the position of the target to thereby prevent over-travel of the first depending arm. The pulley includes a mechanical stop including at least two circumferentially spaced stop members adapted to engage a stop member mounted on the support arm. The mechanical stop is mounted on the pulley to prevent over-travel of the first depending arm. Alternatively, the mechanical stop includes a first cross member mounted on the support arm for bearing against an edge surface on the first depending arm, thereby limiting pivoting of the first depending arm in a first direction, and a second cross member mounted on the first depending arm for bearing against an end surface of a member mounted to the first cross member and thereby limiting pivoting of the first depending arm in a second direction.

For the powered gait orthosis described above, the drive means for moving the second depending arm of each leg actuator assembly includes a motor supported by the first depending arm of the associated leg actuator assembly. The motor is interconnected by a belt with a pulley drivingly connected to the second depending arm. The pulley includes a plurality of outwardly projecting teeth matingly engaged with inwardly projecting teeth on the belt. The pulley is connected to a shaft defining the second generally horizontal axis by a key so as to transmit rotational motion to the second depending arm. The second depending arm is retained in position on the shaft by at least one lock nut. A sensor is provided for sensing a target mounted on the pulley and is adapted to sense the position of the target to thereby prevent over-travel of the second depending arm. The pulley includes a mechanical stop including at least two circumferentially spaced stop members adapted to engage a stop member mounted on the first depending arm. The mechanical stop is mounted on the pulley to prevent over-travel of the second depending arm.

For the powered gait orthosis described above, the first attachment means is supported by the first depending arm and is vertically adjustable relative thereto. The first depending arm includes at least one guide rod and further includes a vertically movable portion slidably mounted on the guide rods. A constant force counter balance spring is connected to the vertically movable portion. The constant force counter balance spring is disposed on the shaft defining the first generally horizontal axis.

For the powered gait orthosis described above, the first attachment means includes a support member, and further includes locking means for locking the support member in adjusted position relative to the first depending arm. The first attachment means includes a first attachment cuff swiveled about a substantially horizontal axis and supported by the support member. The first attachment cuff is horizontally adjustable relative to the support member and includes locking means for locking the first attachment cuff in a generally horizontal adjusted position relative to the support member. A laterally extending arm is connected to the vertically movable portion for mounting the first attachment means.

For the powered gait orthosis described above, the second attachment means is supported by the second depending arm and is vertically adjustable relative thereto. The second depending arm includes at least one guide rod and a vertically movable portion slidably mounted on the guide rods. A constant force counter balance spring is connected to the vertically movable portion. The constant force counter balance spring is disposed on a shaft defining the second generally horizontal axis. A cross member is disposed within the first depending leg adjacent the constant force counter balance spring, and a guide mounted on the cross member prevents movement of the constant force counter balance spring along the second generally horizontal axis. The second attachment means includes a support member, and further includes locking means for locking the support member in adjusted position relative to the second depending arm. The second attachment means includes a second attachment cuff swiveled about a substantially horizontal axis and supported by the support member. The second attachment cuff is horizontally adjustable relative to the support member and includes locking means for locking the second attachment cuff in a generally horizontal adjusted position relative to the support member. A laterally extending arm is connected to the vertically movable portion for mounting the first attachment means.

For the powered gait orthosis described above, the lifting means includes a beam mounted adjacent an inner end thereof to the lifting means. The beam includes an outer end for supporting the harness and extends generally over a point substantially adjacent a longitudinal central axis of the treadmill. The outer end of the beam includes a harness support means rotatably adjustable about a generally vertical axis. The harness support means is rotationally affixed to the beam by a swivel bolt. A shaft of the swivel bolt extends through a load cell and a load cell support, and a head of the swivel bolt is disposed above the load cell to impart a downward force on the load cell for weighing a patient. The harness support means includes at least one harness hanger having a plurality of holes for attachment of the lifting harness. A rotational orientation of the harness support means is fixedly adjustable at predetermined angular intervals relative to the beam by a locking roller engageable with a plurality of recesses in a lock plate mounted to the harness support means to thereby retain the harness support means in a first the rotational orientation when the locking roller is engaged with a recess and allow the harness support means to freely rotate when the locking roller is disengaged from the recesses. The locking roller is retained in one the recesses by a lever affixed to an armature, the armature being biased by a compression spring to impart a retaining force on the locking roller and being disposed in a solenoid affixed to the beam.

For the powered gait orthosis described above, the drive means for driving the lifting means is disposed in one of the vertically extending tower which houses components of the powered gait orthosis and includes a motor drivingly connected to a lead screw engaged with a screw nut mounted in a member interconnected with the lifting means, to thereby convert rotational movement of the lead screw into generally vertical translation of the lifting means. At least one guide tube is disposed within the tower including the drive means for driving the lifting means, are mounted to the member, and further extend through holes in first and second generally horizontal support members for guiding the generally vertical translation of the lifting means.

For the powered gait orthosis described above, a control panel is supported by one of the spaced leg actuator assemblies. A pair of hand holds extend generally toward one another and are each supported by one of the leg actuator assemblies.

The present invention further provides a powered gait orthosis including a treadmill for acting on the feet of a patient. The treadmill has opposite sides and drive means for driving the treadmill. A pair of spaced leg actuator assemblies are disposed at the opposite sides of the treadmill and each include a housing which supports a support arm. Adjusting means are provided for moving the support arm vertically with respect to the housing. A first depending arm has upper and lower ends, the upper end being pivotally supported by the support arm. A second depending arm has upper and lower ends, the upper end being pivotally supported by the lower end of the first depending arm. First depending arm drive means is provided for moving the first depending arm about the pivot axis thereof. Second depending arm drive means is provided for moving the second depending arm about the pivot axis thereof. First attachment means is disposed adjacent the lower end of the first depending arm for attaching the first depending arm to a patient's leg just above the knee of the patent's leg. Second attachment means is disposed adjacent the lower end of the second depending arm for attaching the second depending arm to a patient's leg adjacent the ankle of the patient's leg. A lifting means is adapted to be secured to a lifting harness attached to a patient and is supported by one of the housings and is generally vertically movable relative thereto. Drive means is provided for driving the lifting means generally vertically. Control means is connected to the drive means for the treadmill and the drive means for the first and second depending arms to direct the various drive means attached thereto to operate in a coordinated manner to cause the legs of a patient to move in a desired gait.

The present invention further provides a method of simulating a normal walking pattern for a patient. The method includes the steps of providing a patient with a harness and providing a powered lifting device including a harness attaching portion in a fixed position above a powered treadmill. The method further includes the steps of moving the patient into position directly beneath the attaching portion, attaching the harness to the harness attaching portion of the lifting device, and lifting the patient and lowering the patient onto the powered treadmill. The method yet further includes the steps of providing a powered leg actuator assembly including two leg actuator portions at one side of the treadmill, attaching the first leg actuator portion to the ankle of one leg of the patient and attaching the second leg actuator portion at a point just above the knee of the patient's leg. The method further includes the step of providing control means to separately and independently control the speed of movement of the treadmill, the first leg actuator portion and the second leg actuator portion, to coordinate the movement of the patient's leg to cause the leg to move in a desired gait. The method yet further includes the steps of varying the height of the first and second leg actuator portions relative to the treadmill in accordance with the height of a patient and providing hand holds which are grasped by the patient while the patient's leg is being moved to stabilize the patient's torso. The method further includes the steps of sensing over-travel of the first leg actuator portion to stop the drive means for the first leg actuator portion to prevent damage to a patient's knee and sensing over-travel of the second leg actuator portion to stop the drive means for the second leg actuator portion to prevent damage to a patient's hip. The method further includes the steps of rotating the leg actuator assembly about a generally vertical axis to a position substantially transverse and away from the treadmill so as to facilitate ingress or egress of a patient, rotating the leg actuator assembly into an operative position substantially parallel the treadmill, so as to permit attachment of the first and second leg actuator portions to the leg of the patient, and locking the leg actuator assembly into the operative position.

The present invention further provides a method for simulating a normal walking pattern for a patient. The method includes the steps of providing a patient with a harness, providing a powered lifting device including a harness attaching portion in a fixed position above a powered treadmill and moving the patient into position directly beneath the attaching portion. The method further includes the steps of attaching the harness to the harness attaching portion of the lifting device, lifting the patient and lowering the patient onto the powered treadmill, and providing a pair of powered leg actuator assemblies at opposite sides of the treadmill, each of the leg actuator assemblies including two leg actuator portions. The method yet further includes the steps of attaching the first leg actuator portion at one side of the treadmill to the ankle of one leg of the patient, attaching the second leg actuator portion at one side of the treadmill at a point just above the knee of one leg of the patient, attaching the second leg actuator portion at the opposite side of the treadmill to the ankle of the other leg of the patient, and attaching the second leg actuator portion at the opposite side of the treadmill at a point just above the knee of the other leg of the patient. The method further includes the step of providing control means to separately and independently control the speed of movement of the treadmill, each of the first leg actuator portions and each of the second leg actuator portions, to coordinate the movement of the patient's legs to cause the legs to move in a desired gait.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE PREFERRED EMBODIMENT(S)

Figures 1, 21:
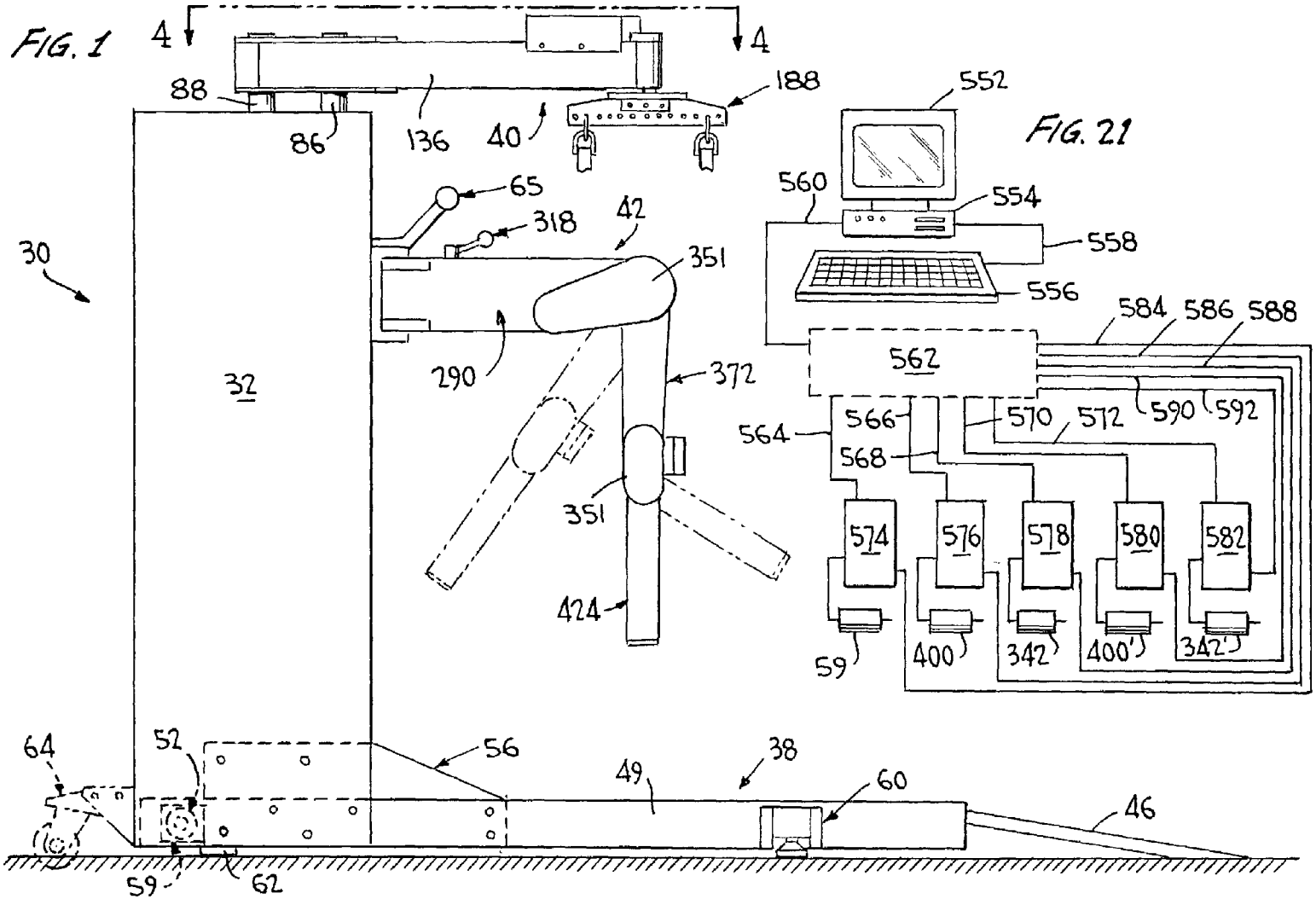
FIG. 1 is a side view of the powered gait orthosis according to the present invention illustrating the simulated walking movements of the depending arms.
FIG. 21 is a schematic wiring diagram of the control system.
Figure 2:
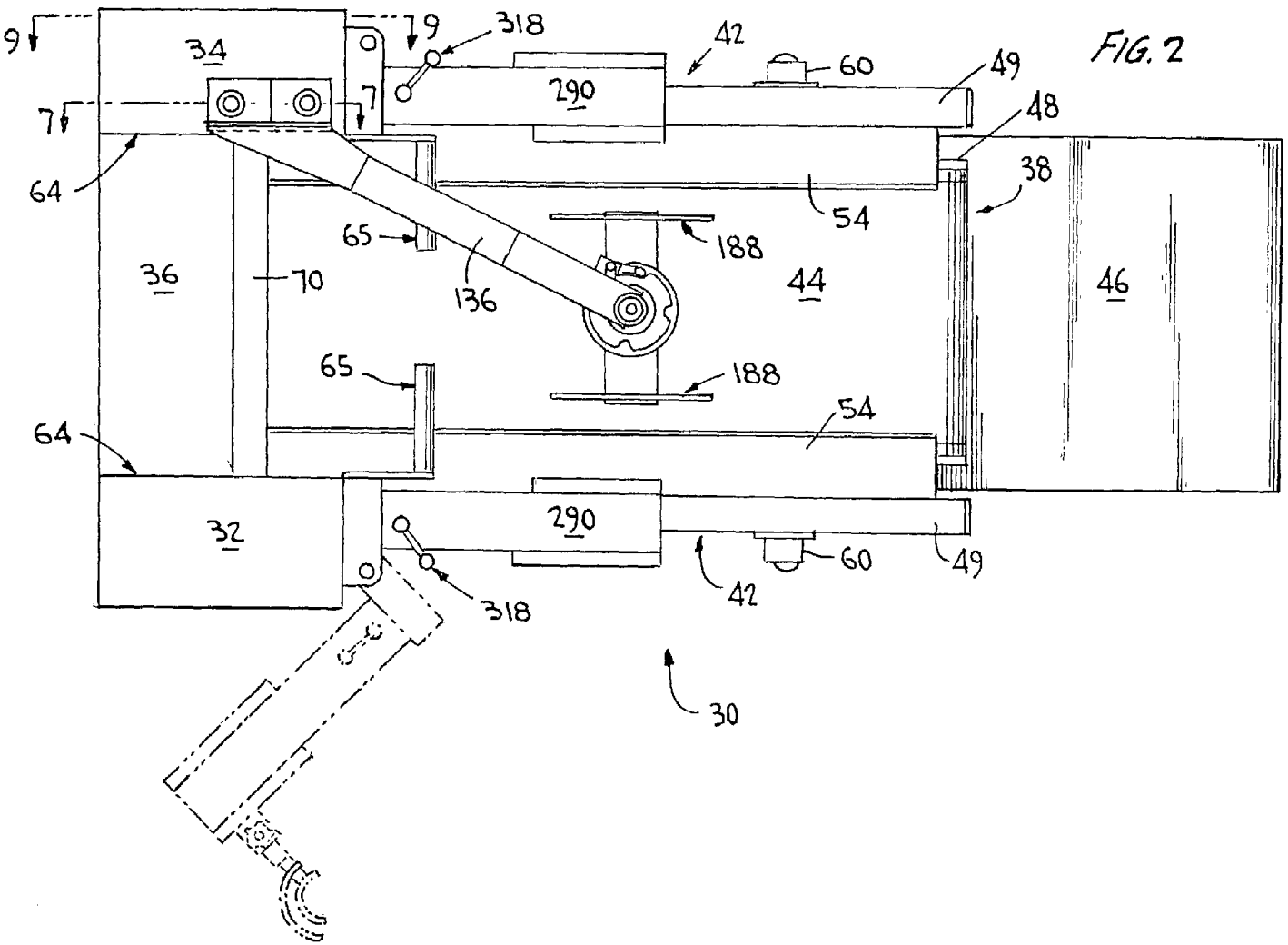
FIG. 2 is a top view of the structure of FIG. 1, illustrating the pivoting adjustability of the horizontal support arms.
Figure 3:
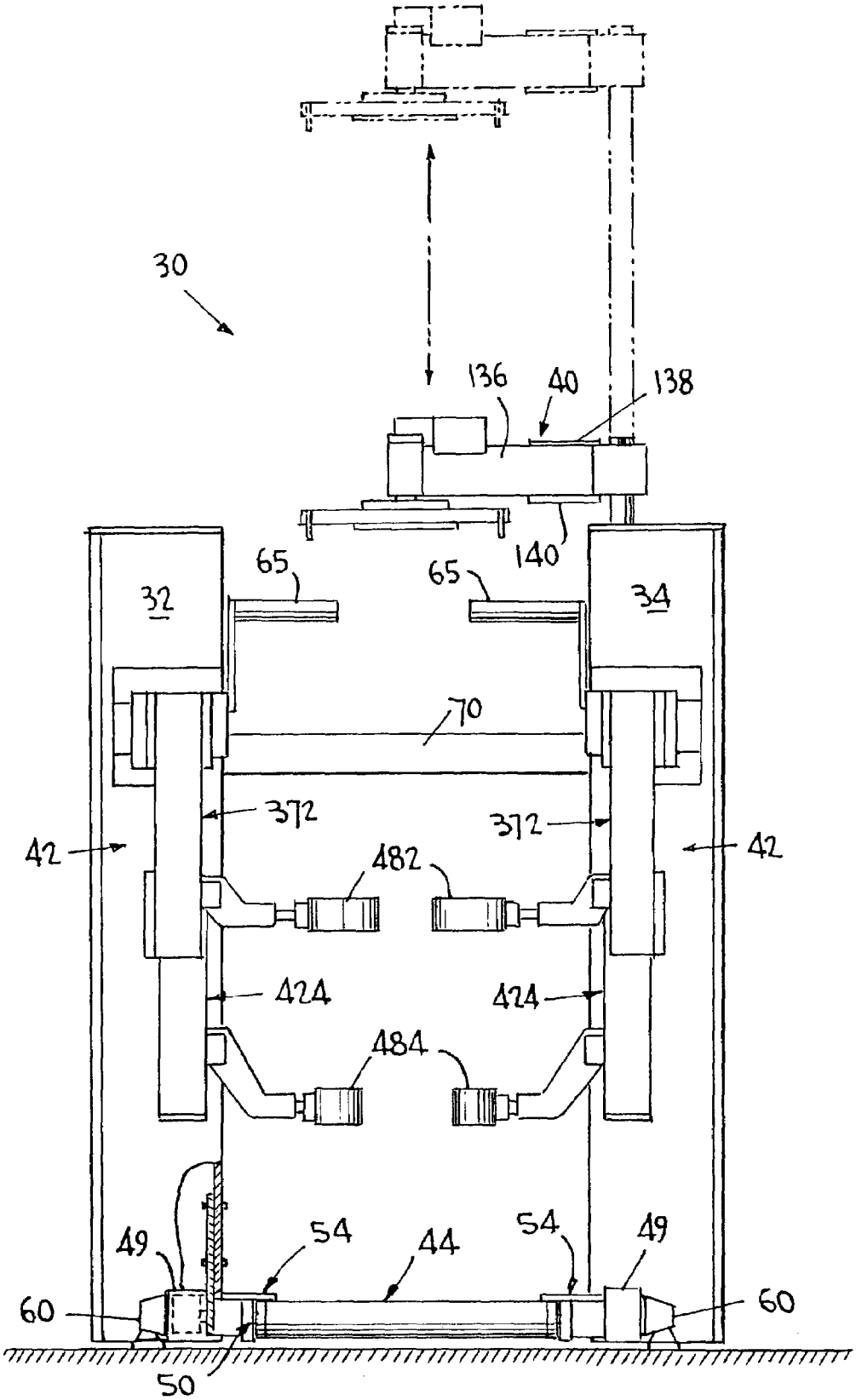
FIG. 3 is a rear view the structure of FIG. 1, illustrating vertical adjustability of the lifting mechanism.

Referring now to the drawings wherein like reference numerals designate corresponding parts throughout the several views, FIGS. 1, 2 and 3 illustrate a powered gait orthosis according to the present invention, generally designated 30.

Powered gait orthosis 30 generally includes vertically extending towers 32, 34, having a horizontal connecting plate 36 extending therebetween, and also extending partially over the top of a treadmill 38 (see FIG. 2). Powered gait orthosis 30 further includes lifting mechanism 40 for lifting and supporting a patient over treadmill 38 along a central longitudinal axis of treadmill 38, and a pair of gait simulation assemblies 42, each for controlling a respective leg of a patient.

Treadmill 38 includes a belt 44 and a removable ramp 46 for facilitating ingress or egress of a patient. Treadmill 38 further includes a frame 48 having a pair of mirror-image box beams 49 for rotatably supporting rollers 50 and 52 at opposite ends thereof. Belt 44 is trained around rollers 50, 52, in a conventional manner, and the usual deck assembly 54 is provided. A pair of mirror-image plates 56 are bolted between towers 32, 34, and each side of treadmill 38, respectively, thereby rigidly connecting treadmill 38 to towers 32, 34. For example, as seen in FIG. 1, a first plate 56 is bolted at its upper end to an inner side of tower 32 and welded at its lower end to an outer side of a box beam 49. The second plate 56 is bolted on the opposite side of treadmill 38 in a like manner as the first plate 56. Rollers 50, 52 are rotatably supported at opposite ends thereof by a pair of similar conventional bearings 58 (not shown), mounted as by bolting on box beams 49 and by bolting on plates 56, respectively. A conventional servo motor 59 is supported by a bracket connected to a gear box drivingly connected to shaft of roller 52, as described in U.S. patent application Ser. No. 09/938,825.

As shown in FIG. 1, a pair of conventional adjustable support pads 60 (only one shown) are provided on opposite outer sides of box beams 49. Likewise, a pair of conventional adjustable support pads 62 (only one shown) are provided in spaced relationship to pads 60 for thereby supporting powered gait orthosis 30. Support pads 60 and 62 may be adjusted to thereby adjust the height and/or inclination of powered gait orthosis 30. Optionally, an adjustable caster mechanism such as 64 shown in phantom line may be used in addition of support pads 60, 62 and interconnected at opposite ends of powered gait orthosis 30 for movement thereof from one position to another.

The structure and method for controlling vertical translation of lifting mechanism 40 will now be described in detail.

Figure 7:
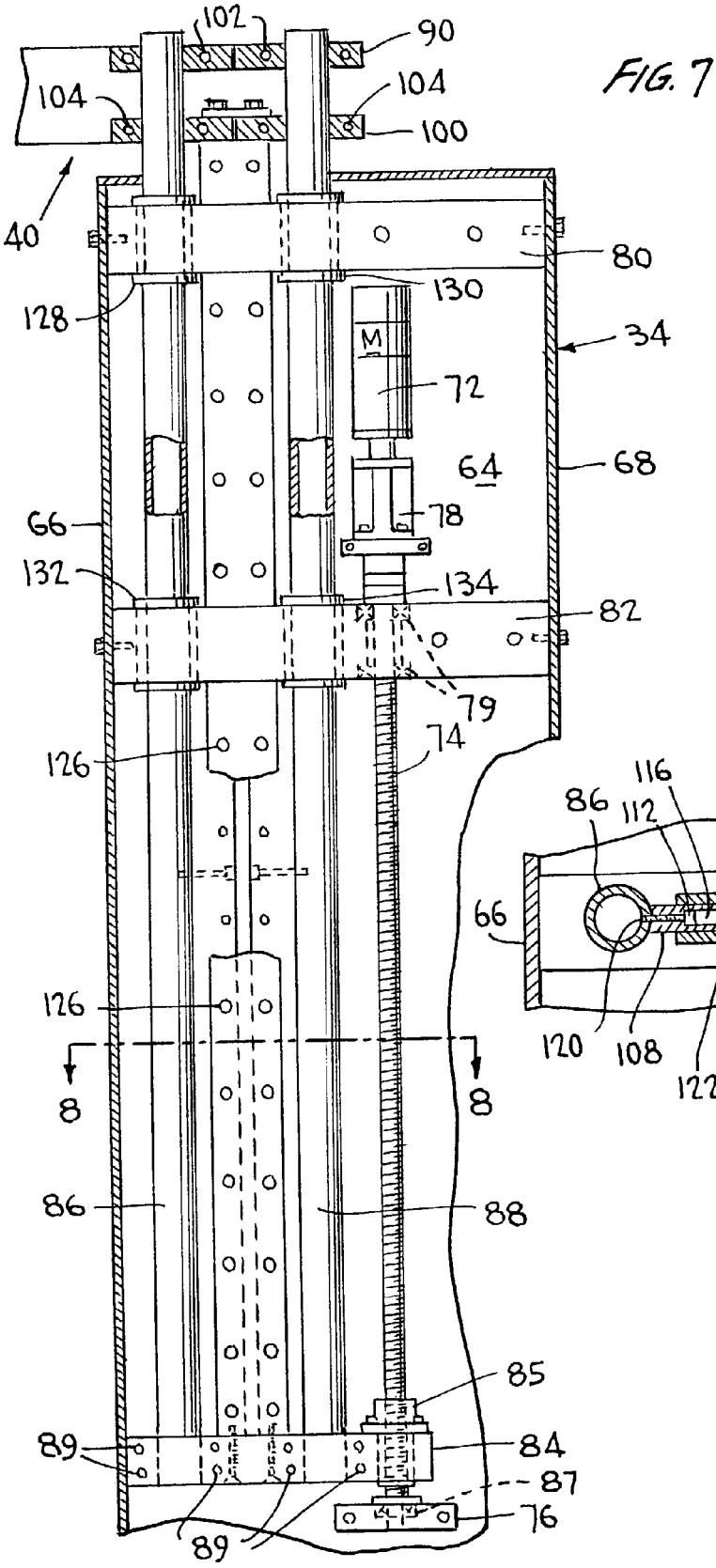
FIG. 7 is a partial front sectional view of the lifting assembly for the lifting mechanism of FIG. 3.

Referring to FIG. 7, each tower 32, 34 includes inner wall 64, rear wall 66 and forward wall 68. As seen in FIGS. 2 and 3, a cross brace 70 is bolted at opposite ends thereof to inner walls 64 of towers 32, 34. A motor 72 is drivingly connected to an upper end of a lead screw 74 for vertical translation of lifting mechanism 40 disposed in tower 34. Lower end of lead screw 74 is supported by thrust bearing 87 to fixed fitting 76 also secured to inner wall 64 of tower 34. Motor 72 is supported by gear box 78 also fixed to inner wall 64 of tower 34. A first horizontal support member 80 is bolted to rear wall 66 and forward wall 68, and may also be bolted to inner wall 64. A second horizontal support member 82 is spaced below first horizontal support member 80 and is similarly bolted to rear wall 66 and forward wall 68, and may also be bolted to inner wall 64. Lead screw 74 extends through support bearings 79 disposed in a suitable opening provided through second horizontal support member 82.

Lifting mechanism 40 also includes a vertically movable unit, which includes a lower member 84, which receives lead screw 74, whereby rotation of lead screw 74 relative to lower member 84 causes vertical movement of lower member 84. Lower member 84 carries a screw nut 85, which has an internally threaded bore securing lead screw 74.

A pair of spaced vertical guide tubes 86, 88 are provided for guiding vertical translation of second horizontal support member 82. The tubes 86, 88 have the lower ends thereof clamped between opposite halves of lower member 84 and are held in place by a plurality of screws 89, whereby lower member 84 is rigidly affixed to lower ends of tubes 86, 88. The upper ends of tubes 86, 88, are interconnected with a first pair of plates 90, and are also interconnected with a second pair of spaced plates 100. Each of the plates 90, 100 comprises two similar halves, which are clamped around tubes 86, 88, by means of bolts 102, 104, respectively. It is apparent that tubes 86, 88 may be solid or hollow, and may have a circular or non-circular cross-section for permitting translation of second horizontal support member 82.

Figures 4, 5:
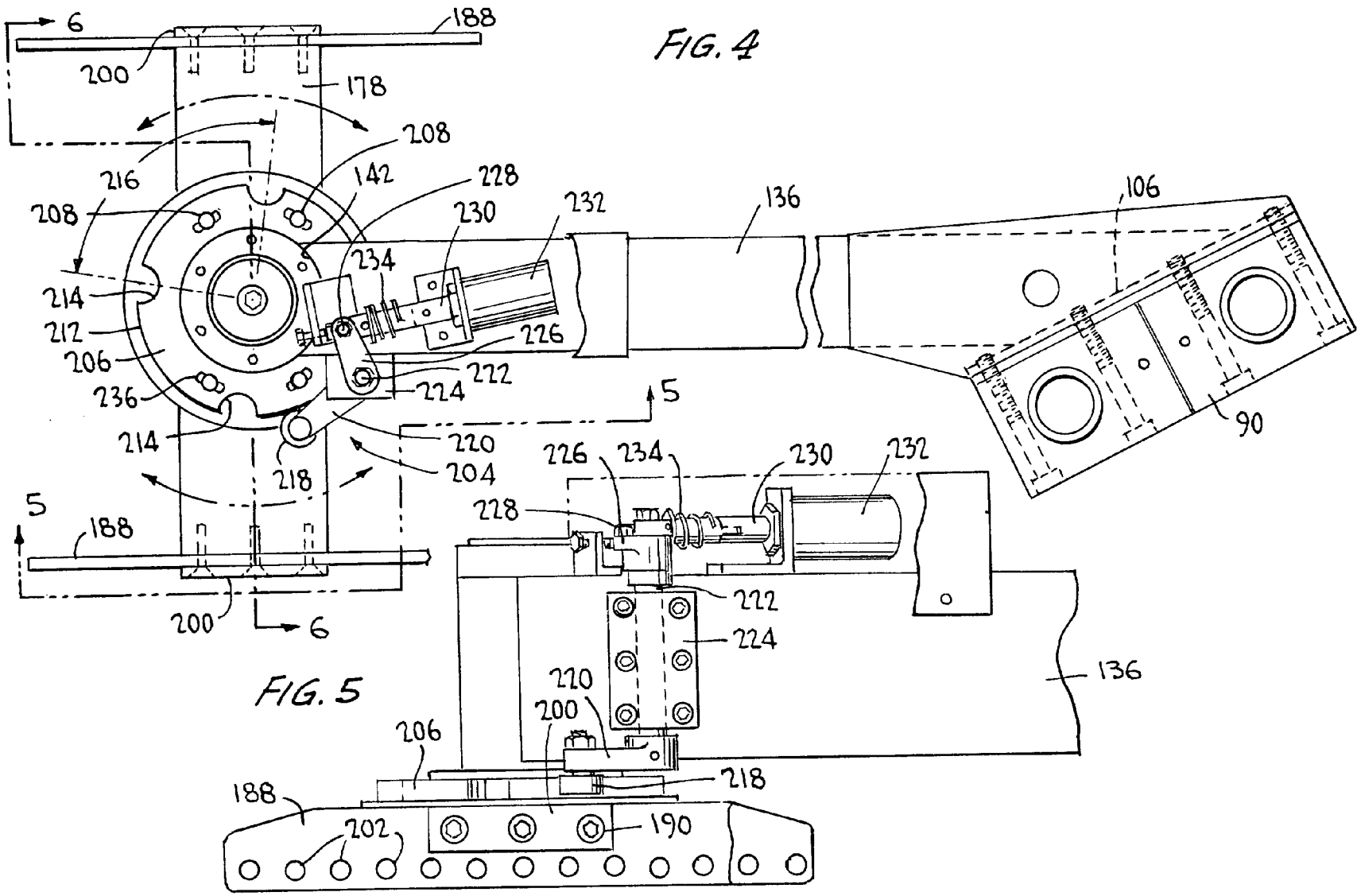
FIG. 4 is an enlarged top view of the lifting mechanism of FIG. 3.
FIG. 5 is a partial side view of the harness hanger of FIG. 4, taken along line 5—5 in FIG. 4.

Referring to FIGS. 4 and 7, a vertical plate 106 is also connected to plates 90 by bolts 102, while plate 106 is also connected to plates 100 by bolts 104.

Referring to FIG. 7, a pair of vertical plates 108, 110 are connected to tubes 86, 88, respectively, by a plurality of cap screws 112, 114, which are disposed within counter bores 116, 118 formed at vertically spaced points along plates 108, 110, respectively. Cap screws 112, 114 extend through counter bores 116, 118 in the associated vertical plates 108, 110 and are threaded into threaded holes 120 formed in the associated tubes 86, 88.

A pair of plates 122, 124 are engaged in opposite sides of plates 108, 110 and are affixed thereto by screws 126 extending through aligned openings in plates 108, 110 and plates 122, 124, respectively, to thereby rigidly interconnect the two tubes 86, 88 with one another.

Figure 8:
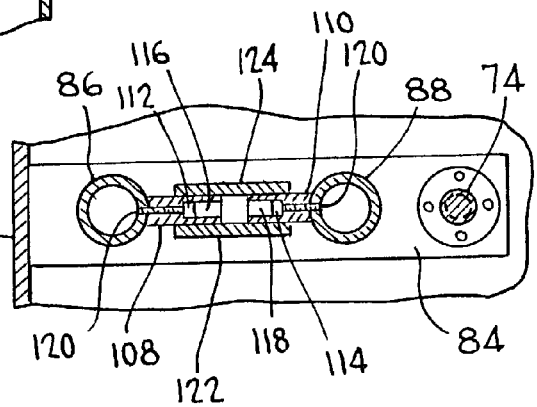
FIG. 8 is a top sectional view of the guide tubes for the lifting assembly of FIG. 7, taken along line 8—8 in FIG. 7.

Tubes 86, 88 are received in linear bearings 128, 130, respectively, mounted in first horizontal support member 80. Member 80 is also provided with a suitable cutout formed vertically therethrough for receiving the structure shown in FIGS. 7 and 8, and described above, for rigidly interconnecting tubes 86, 88. In a similar manner, second horizontal support member 82 is provided with linear bearings 132, 134, and likewise has a vertical cutout formed therethrough, similar to that of member 80.

Referring to FIGS. 3, 4 and 5, lifting mechanism 40 also includes a box beam 136, the inner end of which is welded to the face of vertical plate 106. A pair of similar horizontal plates 138, 140 are welded to the upper and lower surfaces of box beam 136 and are also welded to vertical plate 106.

Figure 6:
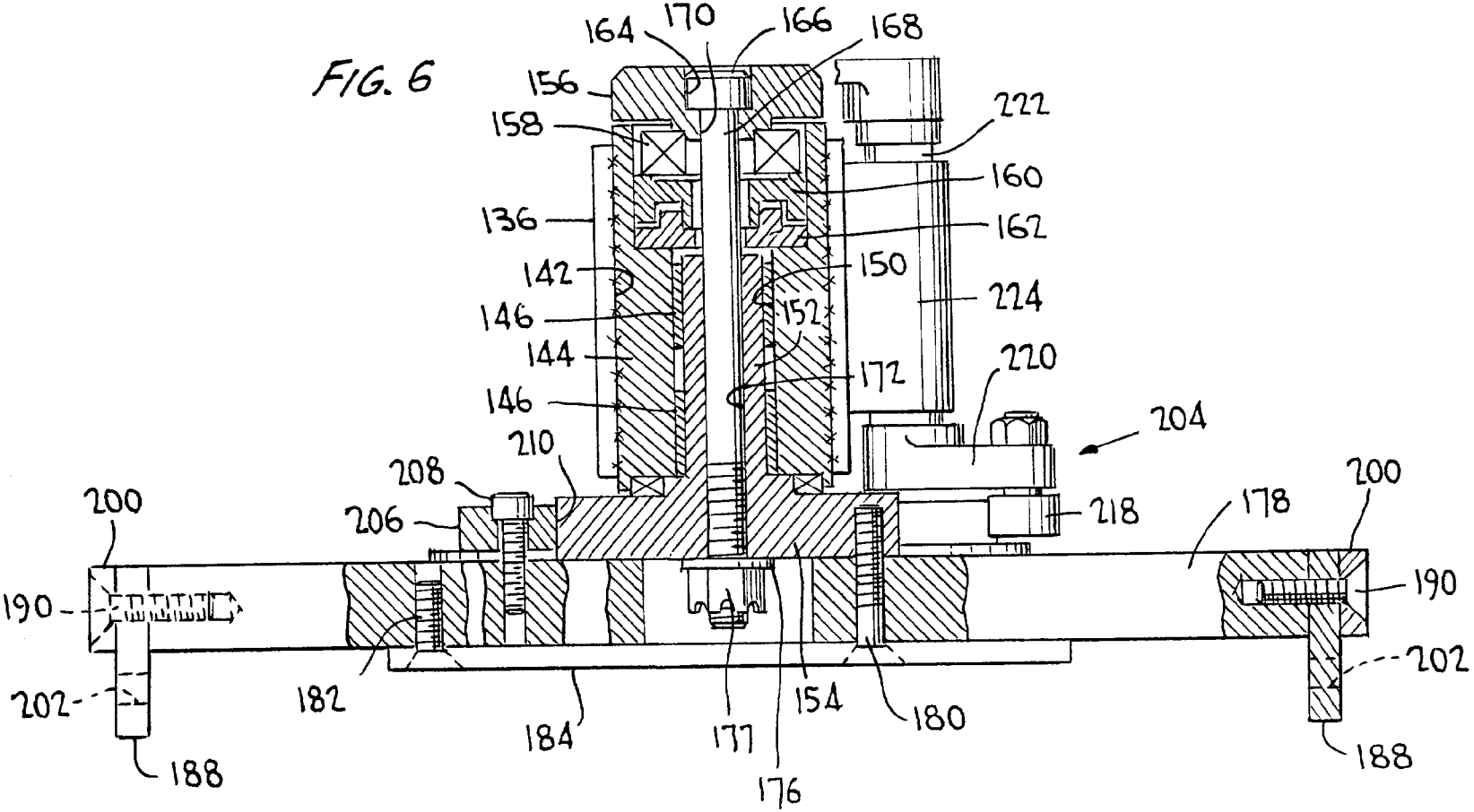
FIG. 6 is a partial sectional view of the rotatably adjustable assembly taken generally along line 6—6 in FIG. 4, illustrating the load cell for weighing a patient.

As seen in FIGS. 4, 5 and 6, the outer end of box beam 136 has a semi-circular cutout 142 formed from the upper to the lower surface thereof. A counter-bored cylindrical member 144 is received within semi-circular cutout 142 of box beam 136 and is welded thereto.

Referring to FIG. 6, a pair of spaced bushings 146 are mounted within a through-hole 150 and are rotatably support a cylindrical portion 152 of a rotatable member 154. A swivel head 156 is rotatably supported by annular bearing 158, and bears upon a load cell 160 disposed on a load cell support 162 disposed within counter-bored cylindrical member 144. Load cell 160 allows for accurate weight measurement of a patient supported by lifting mechanism 40.

Swivel head 156 has a counter bore 164 which receives the head 166 of swivel bolt 168 which extends through a through hole 170 in swivel head 156 and also is received within a through hole 172 formed in rotatable member 154. The lower end of swivel bolt 168 is threaded and is received within through hole 172 of rotatable member 154.

A washer 176 is disposed around lower end of swivel bolt 168, and a castellated nut 177 is threaded on the lower end of swivel bolt 168 and is held in place by a conventional cotter pin (not shown) to ensure that rotatable member 154 and swivel bolt 168 rotate together. A swivel cross member 178 is connected to rotatable member 154 by a plurality of flat-head screws 180, which also connect swivel cover 184 to swivel cross member 178. Additionally, a plurality of additional flat-head screws 182 connect swivel cover 184 to swivel cross member 178.

A pair of harness hangers 188 are connected to the opposite ends of swivel cross member 178 by flat-head screws 190, which also hold end plates 200 in position. Each of the harness hangers 188 is provided with a plurality of holes 202 formed therethrough for attaching a harness to lifting mechanism 40. An exemplary harness which may be used with power gate orthosis 30 of the present invention, is disclosed in pending U.S. application Ser. No. 10/082,153, filed Feb. 26, 2002, the disclosure of which is incorporated herein by reference.

Referring to FIGS. 4, 5 and 6, a locking means, generally designated 204, is provided for locking swivel cross member 178 in a desired operative position. Locking means 204 includes a lock plate 206 secured to swivel cross member 178 by a plurality of screws 208. Lock plate 206 has a central opening 210, which receives the outer surface of rotatable member 154. As shown in FIG. 4, lock plate 206 has an outer periphery 212 having a plurality of recesses 214 formed therein at equally spaced intervals 216. Locking means 204 includes a locking roller 218 which is rotatably supported at the outer end of a lever 220. The opposite end of lever 220 is fixed to the lower end of a shaft 222 which is rotatably supported within a bearing block 224 attached to box beam 136. Referring to FIGS. 4 and 5, the upper end of shaft 222 is pivotally connected to one end of a further lever 226, the opposite end of lever 226 being fixedly connected at 228 with the outer end of armature 230 of solenoid 232. A compression spring 234 normally urges lever 226 and locking roller 218 into the position shown in FIG. 4, wherein locking roller 218 is not disposed within one of the recesses 214, this being the unlocked position. When solenoid 232 is actuated, locking roller 218 will be urged inwardly so as to move into a recess 214 when recess 214 is aligned with locking roller 218. For fine adjustment of lock plate 206 relative to swivel cross member 178, lock plate 206 is provided with a plurality of slots 236 which receive screws 208 whereby the angular position of lock plate 206 relative to swivel cross member 178 can be adjusted. It should be apparent that the swivel cross member 178 can be rotated into different angular positions as desired when moving a patient onto powered gait orthosis 30 and then locked in position by the locking means 204 described above.

The structure and method for controlling vertical translation of gait simulation assemblies 42 will now be described in detail.

Figure 9:
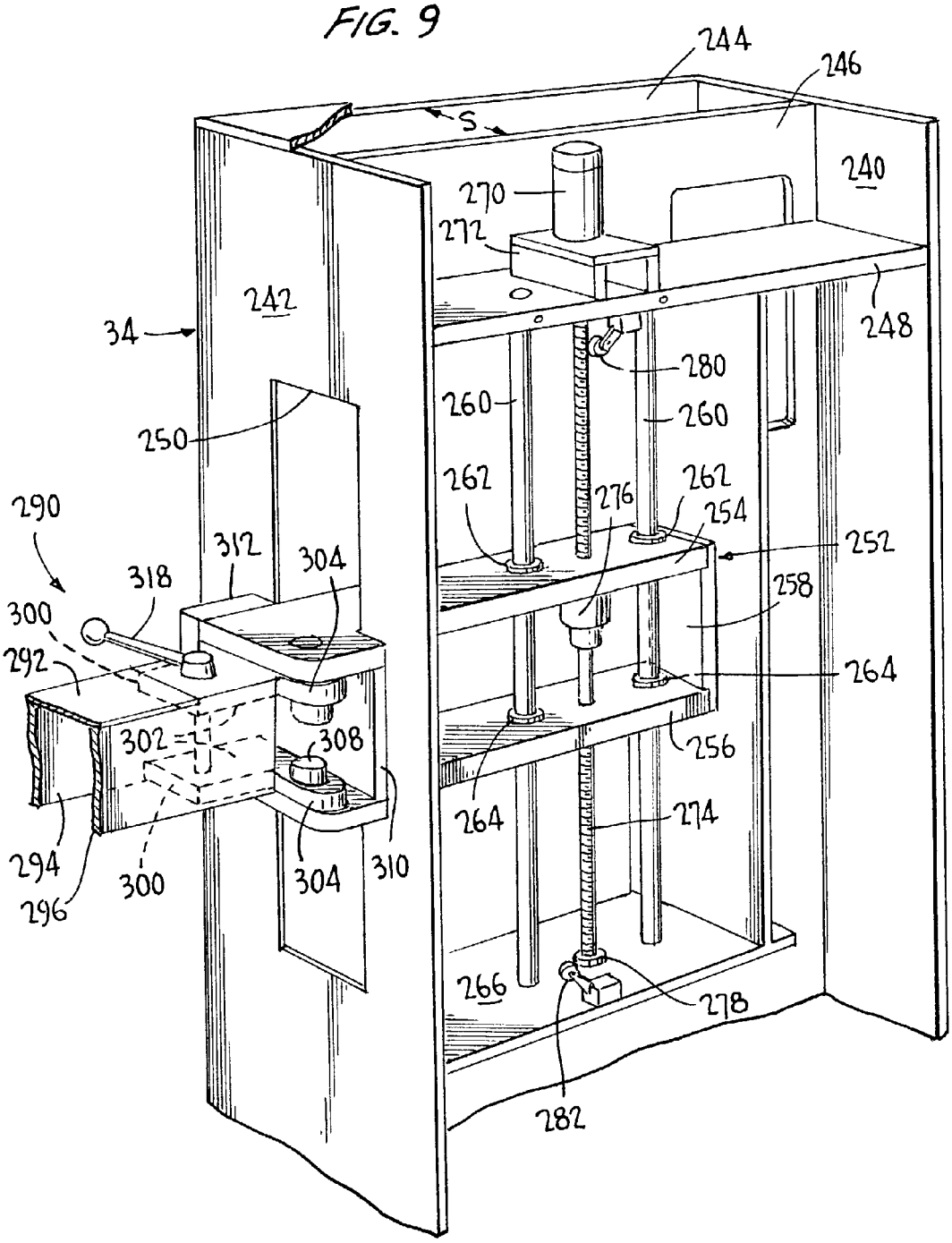
FIG. 9 is a partial perspective sectional view of the lift assembly for a horizontal support arm, wherein an outer wall of vertically extending tower 34 is removed (compared to the assembly shown in FIG. 3)

Referring to FIG. 9, vertically extending tower 34 (shown with an outer wall removed), includes a forward wall 240, a rearward wall 242, an inner wall 244 and a further wall 246 spaced from and disposed parallel to inner wall 244 to define a space S therebetween. A cross plate 248 has the opposite ends thereof secured to the inner surfaces of forward and rearward walls 240 and 242, respectively, and may further have a side thereof secured to wall 246. Rearward wall 242 has an elongated vertically extending slot 250 formed therethrough. If desired, a panel (not shown) can be provided for closing off slot 250 when gait simulation assembly 42 (shown in FIG. 1) moves vertically so that the internal mechanism is not exposed. A carriage, indicated generally by 252, has a U-shaped cross-section including a pair of parallel legs 254, 256 joined with an end-plate 258. A pair of vertically extending guide tubes 260 extend through linear bearings 262 disposed in suitable holes in leg 254, and a similar pair of linear bearings 264 are disposed within suitable holes formed in leg 256. The upper ends of guide tube 260 are fixed to cross plate 248 by suitable means, and the lower ends thereof are fixed to a cross plate 266 secured to the lower portions of the inner surfaces of walls 242 and 246. A D.C. motor 270 is mounted on a support 272 secured to the upper surface of cross plate 248, and is drivingly connected with a lead screw 274 which extends through a bushing 276 secured to leg 254 of carriage 252. Lower end of lead screw 274 is connected with a fitting 278 mounted on cross plate 266. Limit switches 280 and 282 are provided for engaging legs 254 and 256, respectively, to limit upward and downward movements of carriage 252. It is apparent that tubes 260 may be solid or hollow, and may have a circular or non-circular cross-section for permitting translation of carriage 252.

Figures 10, 11, 12:
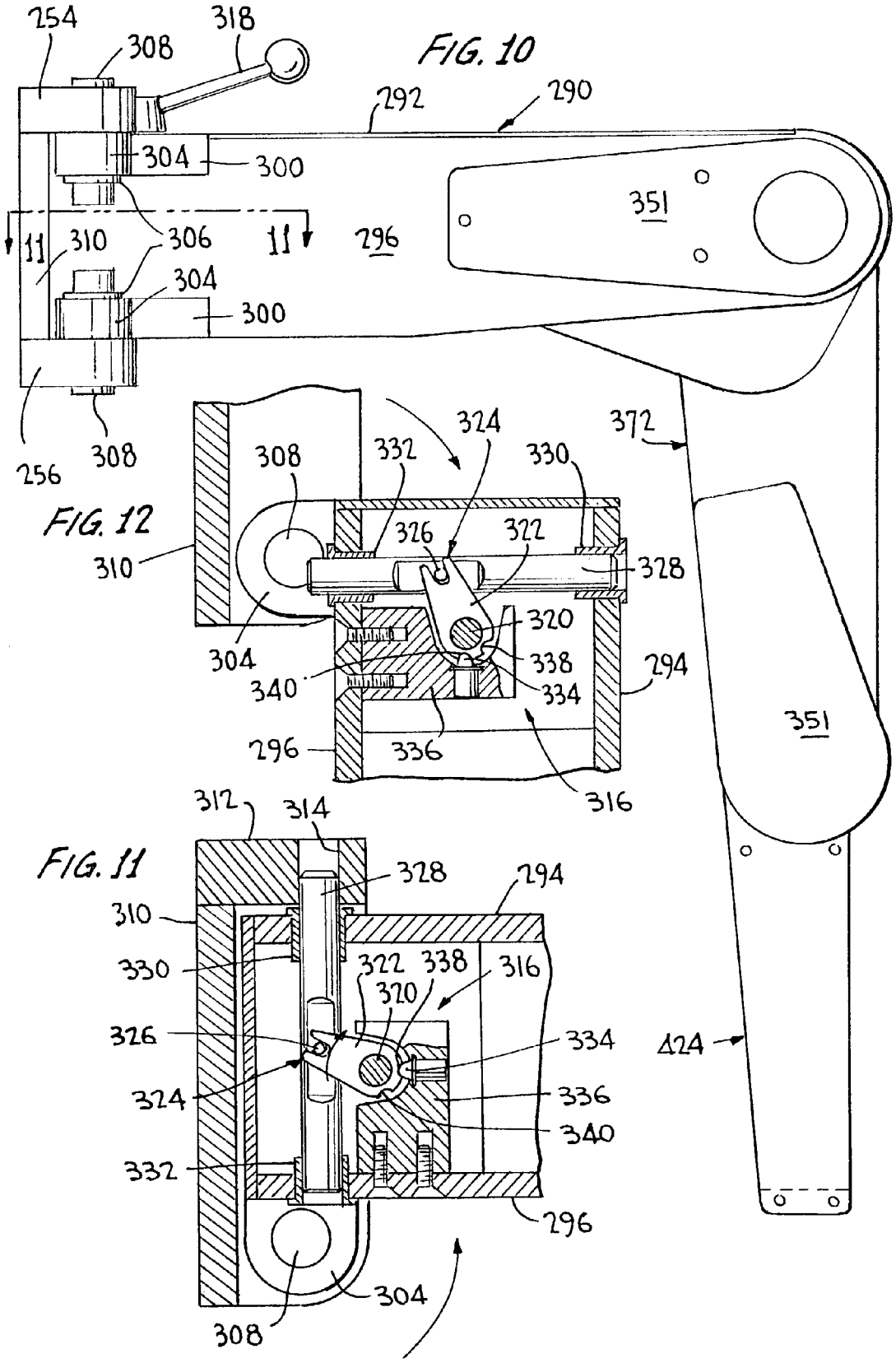
FIG. 10 is a side view illustrating the horizontal support and vertical depending arms, and the pivot mechanism for the horizontal support arms.
FIG. 11 is a sectional view of the pivot mechanism of FIG. 10 taken along lines 11—11 in FIG. 10, illustrating the horizontal support arm in a closed locked position when a patient is supported on the treadmill.
FIG. 12 is a view similar to FIG. 11, illustrating the horizontal support arm in an open unlocked position for allowing entry or egress of a patient relative to the treadmill.

Referring to FIGS. 9-12, a horizontal arm is indicated generally by reference number 290 and has a generally U-shaped cross section including a top plate 292 and a pair of depending plates 294, 296, all bolted together (as seen clearly in FIGS. 9 and 10). At the forward end of horizontal support arm 290, a pair of plates 300 each has a first portion 302 fitted snuggly between inner surfaces of depending plates 294, 296, plates 300 each including a laterally extending rounded portion 304, which supports bushings 306, which rotatably receive pivot pins 308 fixedly secured to legs 254 and 256 to pivotally connect horizontal support arm 290 to carriage 252. A plate 310 is disposed between the undersurface of leg 254 and the upper surface of leg 256.

The lock mechanism for locking horizontal support arm 290 in place will now be described in detail.

As seen in FIGS. 9, 10 and 11, a lock mechanism, generally designated 316, is provided for locking horizontal support arm 290 in its normal operative position as shown in FIGS. 10, 11. Lock mechanism 316 includes a block 312 secured to carriage 252 and has a hole 314 formed therethrough. Since powered gait orthosis 30 includes two mirror-image horizontal arms 290 each including a mirror-image lock mechanism structure, the lock mechanism 316 for only one of the horizontal arms 290 will be described in detail. A manually operable handle 318 is connected with a downwardly extending shaft 320 which is rotatably supported by bushings (not shown) mounted in plate portions 302 of plates 300. An arm 322 is fixed to shaft 320 and includes a bifurcated end 324 which receives a pin 326 extending radially from a slidable bolt 328. Bolt 328 is slidably supported within bushings 330, 332 supported by depending plates 294, 296, respectively. As seen in FIG. 11, bolt 328 is shown in locked position, wherein the bolt extends into hole 314 formed in block 312. Bolt 328 is held in this position by a detent 334 supported in a block 336 bolted to plate 296. Detent 334 is disposed in a first recess 338 formed in arm 322, as seen in FIG. 11. A second recess 340 is provided for retaining bolt 328 in unlocked position, as shown in FIG. 12, wherein horizontal support arm 290 has been rotated 90 degrees to an open position, from the closed position shown in FIG. 11.

Referring to FIGS. 2, 3 and 9, a conventional handle 65 is mounted on inner facing surface of each block 312 for stabilizing a patient's torso.

The structure and method for driving the first and second depending arms 372 and 424, respectively, will now be described in detail.

Figures 16, 17:
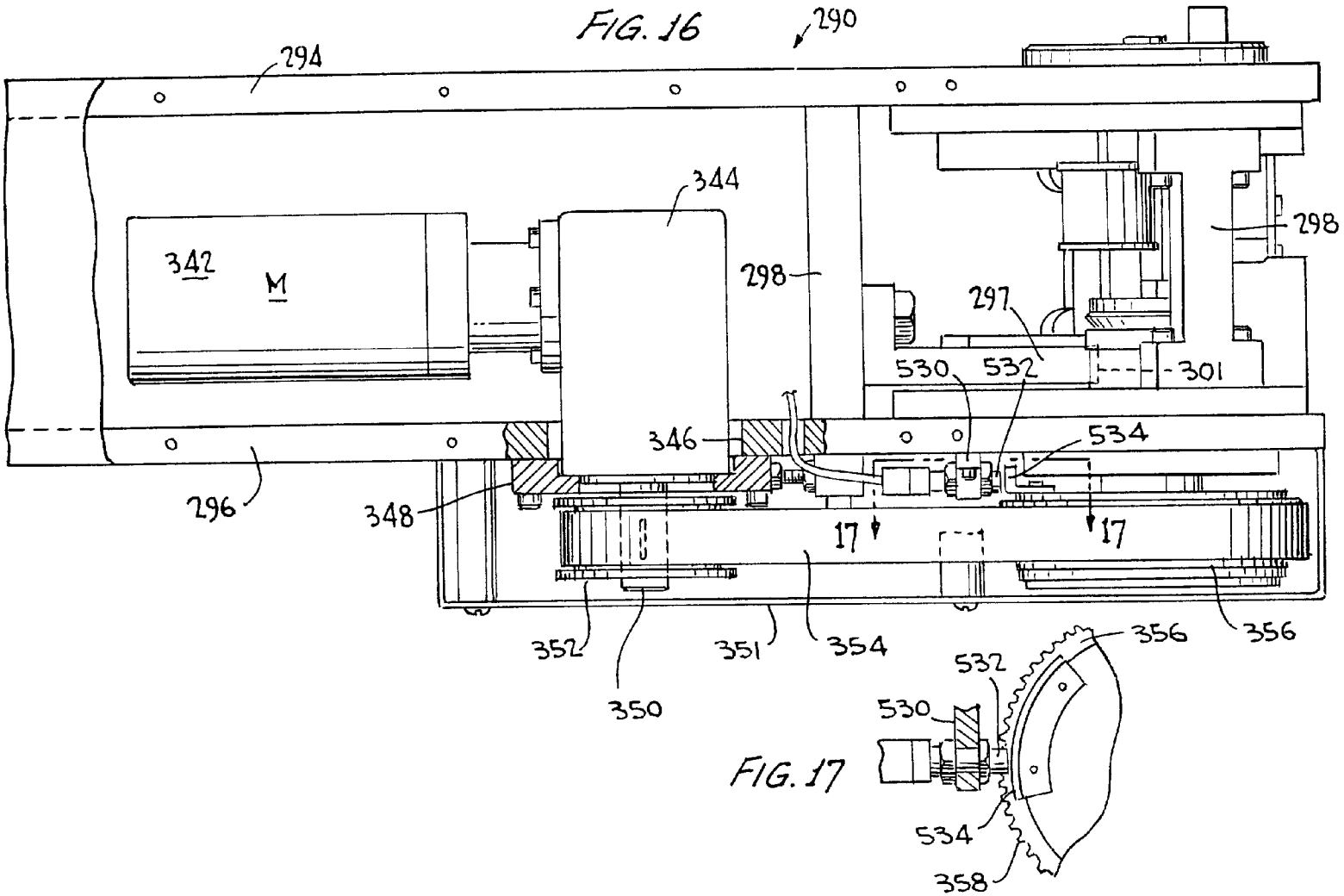
FIG. 16 is a partial sectional top view of the drive mechanism of the first (upper) depending arm.
FIG. 17 is a partial sectional view of the over-travel control assembly for the upper depending arm, taken along line 17—17 in FIG. 16.

Referring to FIG. 16, a servo motor 342 is supported within horizontal support arm 290 and is drivingly connected with a right-angle gear box 344, which extends through an opening 346 in plate 296 and fixed within the counter-bore in a fitting 348. Gear box 344 includes output shaft 350 to which is affixed a drive pulley 352 having outwardly projecting teeth (not shown). A drive belt 354 has inwardly facing recesses formed therein for receiving the teeth on drive pulley 352 to provide a positive drive.

Figure 13:
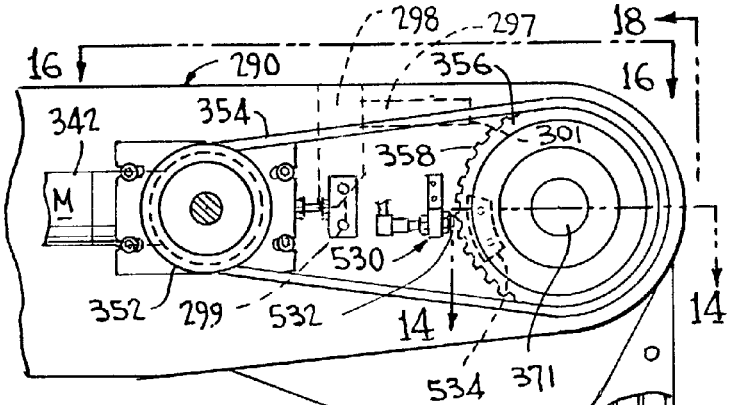
FIG. 13 is a view broken away illustrating the drive mechanism of the horizontal support and depending arms, with the covers shown in FIG. 1 for covering the drive mechanism removed.
Figure 14:
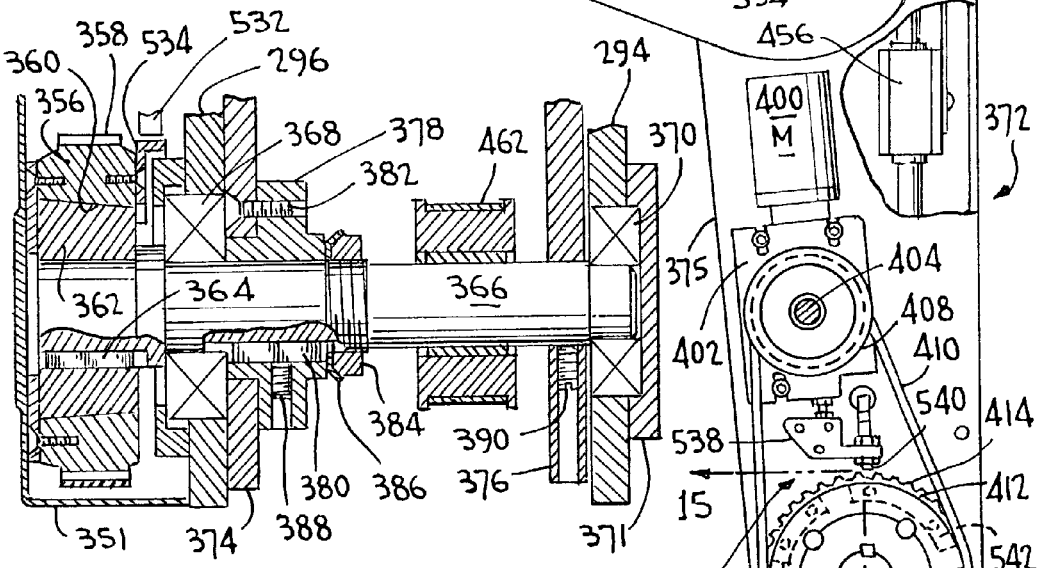
FIG. 14 is a sectional view of the drive mechanism for the first (upper) depending arm, taken along line 14—14 in FIG. 13.

Referring next to FIG. 13 (with cover plates 351 for covering the first and second depending arm drive means removed) and 14, belt 354 is trained over a driven pulley 356 having outwardly extending teeth 358 for providing a positive drive connection with drive belt 354. It is apparent that cover plates 351 may be made of differing sizes as necessary for covering first and second depending arm drive means. As seen in FIGS. 14 and 17, pulley 356 comprises a portion 360 receiving a taper lock bushing 362, which is drivingly connected by a key 364 with shaft 366. Shaft 366 is supported for rotation by a first bearing 368 supported within plate 296 and a second bearing 370 supported within plate 294. Bearing 370 is held in place by cover plate 371 having a counter-bore therein for supporting bearing 370.

A first depending arm, generally designated 372, includes a pair of parallel spaced plates 374, 376. A member 378 is connected by key 380 for rotation with shaft 366. Member 378 is drivingly connected with plate 374 by a plurality of screws 382. A bearing lock nut 384 is threaded onto shaft 366 and a lock washer 386 is disposed between lock nut 384 and member 378 for retaining the components in the position illustrated. A set screw 388 is provided on key 380 for retaining member 378 in the position illustrated. A further set screw 390 is provided for retaining plate 376 in position on shaft 366.

Figure 15:
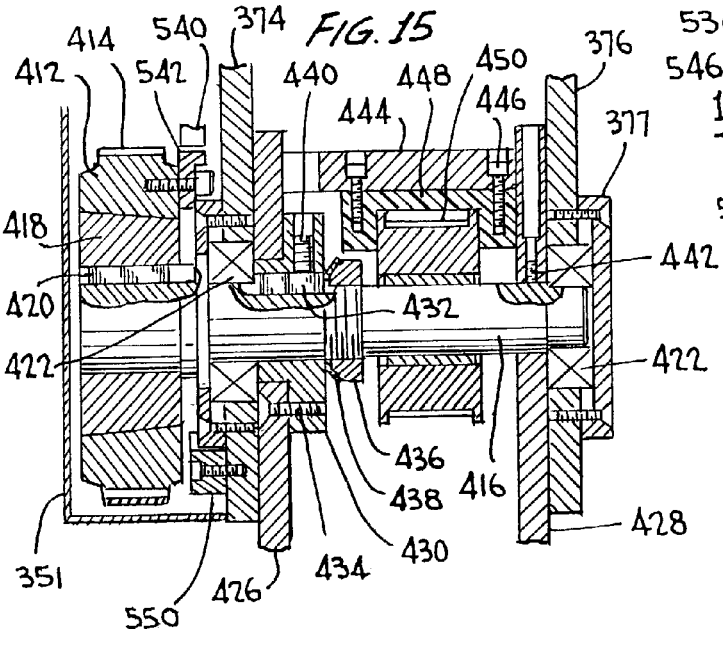
FIG. 15 is a sectional view of the drive mechanism for the second (lower) depending arm, taken along line 15—15 in FIG. 13.
Figures 18, 19, 19A, 20:
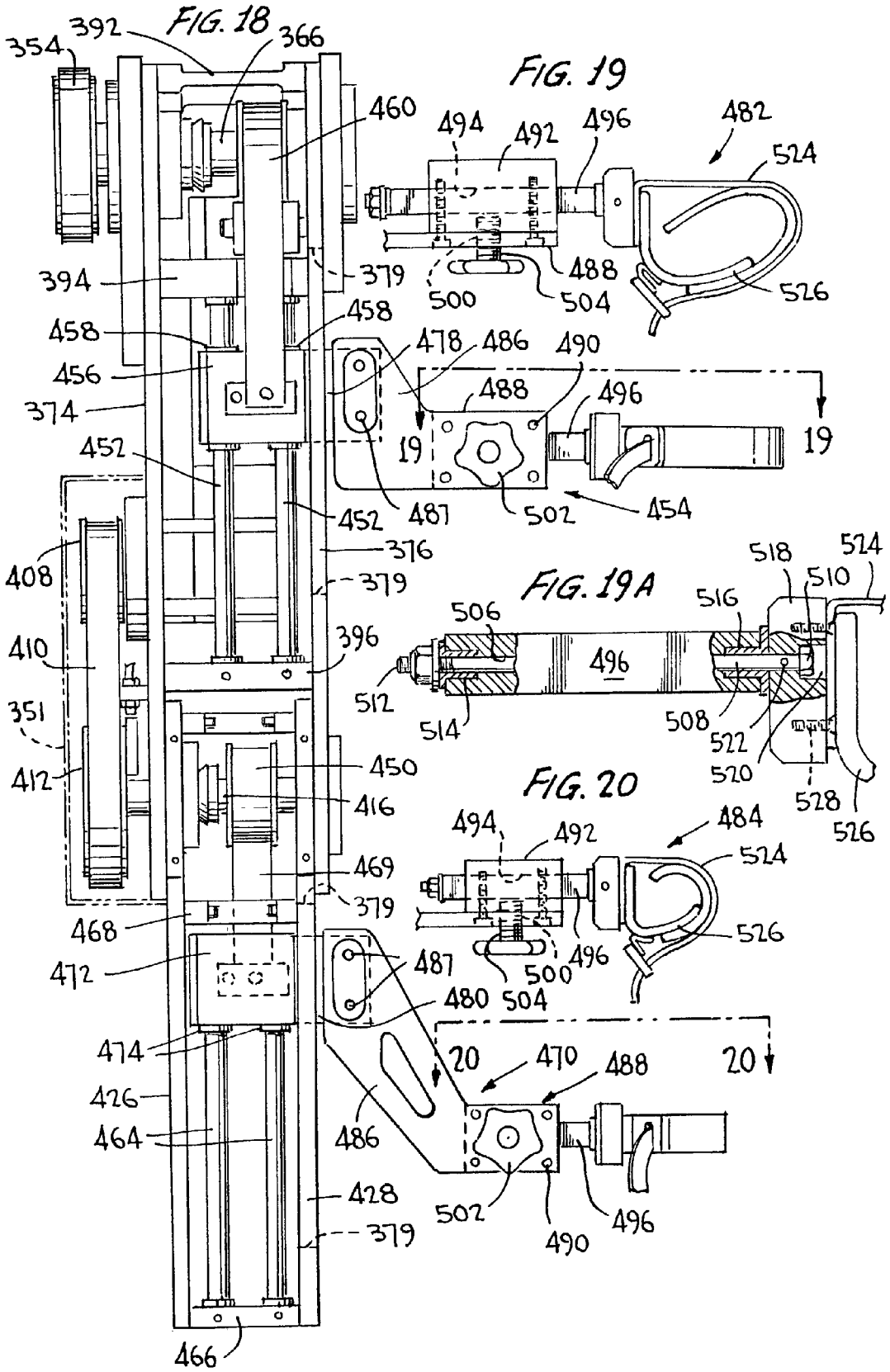
FIG. 18 is a rear view with the cover removed of the gait simulation assembly, illustrating the various components of the attachment means for attachment to a patient's leg.
FIG. 19 is a top view of the thigh support cuff, taken along lines 19—19 in FIG. 18.
FIG. 19A is an enlarged view partly in section of the attachment means (for attaching a cuff to a patient's leg) with the support block removed for clarity.
FIG. 20 is a top view of the ankle support cuff, taken along lines 20—20 in FIG. 18.

Referring to FIG. 18, cross members 392, 394, 396 have the opposite ends thereof secured to the inwardly facing surfaces of plates 374, 376. As seen in FIGS. 13 and 18, a servo motor 400 is mounted between plates 374, 376 and is drivingly connected with a right angle gear box 402 having output shaft 404 to which is secured a drive pulley 408. Referring to FIGS. 13 and 18, drive pulley 408 is of the same type of construction as driven pulley 356 and is drivingly connected with a drive belt 410 which is trained over a driven pulley 412, having teeth 414, of a construction similar to driven pulley 356. Referring to FIGS. 13 and 15, pulley 412 is drivingly connected to shaft 416 by a taper lock busing 418 through a key 420. Shaft 416 is rotatably supported by a first bearing 420 supported by plate 374 and a second spaced bearing 422 supported by plate 376. Bearing 422 is held in place by cover plate 377 having a counter-bore therein for supporting bearing 422.

Referring to FIG. 15, a second depending arm, generally designated 424, includes a pair of parallel spaced plates 426, 428. A member 430 is connected by key 432 for rotation with shaft 416. Member 430 is drivingly connected with plate 426 by a plurality of screws 434. A bearing lock nut 436 is threaded onto shaft 416 and a lock washer 438 is disposed between lock nut 436 and member 430 for retaining the components in the position illustrated. A set screw 440 is provided on key 432 for retaining member 430 in the position illustrated. A further set screw 442 is provided for retaining plate 428 in position on shaft 416.

A cross member 444 is connected between plates 426, 428 and is connected by screws 446 to a plastic guide 448, which has a slight clearance with respect to a constant force counterbalance spring 450 hereinafter described, to prevent movement of spring 450 along shaft 416.

The attachment means for attaching first and second depending arms 372 and 424, respectively, to a patient's legs will now be described in detail.

Referring to FIGS. 18, 19, 19A and 20, the details of construction of the attachment means for attaching the legs of a patient to depending arms 372 and 424 are illustrated.

For the attachment means illustrated, a pair of guide rods 452 extend between cross-members 394, 396. A thigh cuff support assembly, generally designated 454, includes a vertically movable portion 456 which is slidably mounted on guide rods 452 by linear bearings 458. A lower end of a band 460 of a constant force counter-balance spring 462 is connected to vertically movable portion 456. The upper end of the band 460 of constant force counter-balance spring 462, which as seen in FIGS. 14 and 18, is mounted for rotation on shaft 366. A further pair of guide rods 464 are connected between cross-member 466 and a further cross-member 468, the member 468 being connected between the inner surfaces of plates 426, 428 of second depending arm 424. A lower end of a band 469 of constant force counter-balance spring 450 is connected to a vertically movable portion 472. The upper end of band 469 of constant force counter-balance spring 450, which as seen in FIGS. 15 and 18, is mounted for rotation on shaft 416.

Still referring to FIGS. 18, 19, 19A and 20, an ankle cuff support assembly, generally designated 470, includes vertically movable portion 472 which is slidably mounted on guide rods 464 by linear bearings 474. Vertically movable portions 456 and 472 include portions 478 and 480 extending inwardly of the respective first and second depending arms 372 and 424, and pass through suitable slots (illustrated by hidden lines 379) formed in plates 376 and 428, respectively.

The components connected to portions 478 and 480 for the upper and lower attachment means (shown in FIGS. 19 and 20) and generally designated 482 and 484, respectively, are similar to one another and accordingly the same reference numerals have been applied to both such structures. Referring to FIGS. 19, 19A and 20, each attachment means 482 and 484 includes a depending member 486, connected as by screws 487 to portions 478 and 480. Each of depending members 486 includes a horizontally extending portion 488 which is affixed by four screws 490 to a support block 492. Support block 492 has a bore 494 formed therethrough of a rounded cross-section, which slidably receives a rod 496, which has a complementary rounded cross-section with a flat portion extending partially along the length of rod 496. A threaded passage 500 is formed through members 486 and 488, and partly through support block 492 so as to be in communication with bore 494. A knob 502 has a threaded stem 504 threadedly received within bore 500 and is adapted to engage the flat portion of rod 496. It is apparent that knob 502 may be backed off (i.e. loosened) to allow rod 496 to slide within bore 494 to adjust the position of rod 496 in a horizontal direction, whereupon knob 502 may be tightened to secure rod 496 in position. As seen especially in FIG. 19A, rod 496 has a bore 506 formed therethrough of circular cross-section which receives an elongated bolt 508. Bolt 508 includes a head 510 and an opposite end 512. Bushings 514, 516 are received within counter-bores formed at the opposite end of rod 496 and support bolt 508 for rotation relative to rod 496.

A cuff support 518 receives bolt 508, and the head 510 of bolt 588 is received within a recess 520 of cuff support 518. A set screw 522 extends through a suitable bore provided in cuff support 518 and engages bolt 508, so that bolt 508 and cuff support 518 rotate together. A pair of strips 524 and 526 are provided with VELCRO on the facing surfaces thereof and suitable padding so as to form an adjustable cuff for engaging portions of the leg of a patient. Strips 524 and 526 are secured to cuff support 518 by screws 528. It is apparent that cuff support 518 and the VELCRO strips 524 and 526 carried thereby are adapted to swivel with respect to the longitudinal axis of bolt 508 to adapt the attachment means to patients of different size and shape.

The means for sensing and controlling over-travel of first and second depending arms 372 and 424, respectively, will now be described in detail.

As seen in FIGS. 13, 14, 16 and 17, a fitting 530 is secured by screws to plate 296 and supports a proximity sensor 532. Proximity sensor 532 cooperates with a target 534, which is fixed by screws to the inner surface of portion 360 of driven pulley 356. Target 534 is formed of a suitable metallic electrically conductive material such as copper. By sensing target 534, proximity sensor 532 is adapted to sense the position of shaft 366 and prevent over-travel thereof. In addition, a mechanical stop is provided in case the electrically operated proximity sensor 532 does not operate properly. Referring to FIGS. 13 and 16, in case of such failure of sensor 532, for limiting the forward pivoting direction of first depending arm 372, edge 375 of first depending arm 372 contacts edge 299 of cross member 298, which is mounted between plates 294 and 296 on horizontal arm 290, so as to limit over-travel of first depending arm 372. Referring to FIGS. 13 and 18, for limiting the rearward pivoting direction of first depending arm 372, cross member 392 of first depending arm 372 contacts end surface 301 of member 297, which is bolted to cross member 298, so as to limit over-travel of first depending arm 372.

As seen in FIGS. 13 and 15, a second sensor means, generally designated 536, includes a fitting 538 secured to plate 374 by suitable screws and supporting a proximity sensor 540. Proximity sensor 540 cooperates with a target 542 screwed to driven pulley 412 to sense the position of shaft 416 and prevent over-travel thereof. In addition, a mechanical stop, generally designated 544, is provided in case the electrically operated proximity sensor 540 does not operate properly. Mechanical stop 544 includes a pair of spaced stop members 546 and 548 secured to pulley 412 by screws. Spaced stop members 546 and 548 are adapted to engage opposite ends of a stop member 550 screwed to plate 374. It should be apparent that although mechanical stop 544 is shown only for pulley 412, instead of the mechanical stop described above for preventing over-travel of first depending arm 372, a mechanical stop of similar construction as mechanical stop 544 may be mounted on pulley 356 to prevent over-travel of shaft 366 if proximity sensor 532 does not operate properly.

The control means for controlling the various servo motors and sensors described above will now be described in detail.

Referring to FIG. 21, the control means of the invention is schematically illustrated wherein a touch screen 552, which may be attached for example as a unitary unit on an outer surface of tower 32, is electrically connected to a computer or programmable logic controller (PLC) 554 having a suitable program incorporated therein for controlling the various servo motors and sensors described above, and for monitoring and recording patient progress. A conventional keyboard 556 is electrically connected to computer 554 by a lead 558. A lead 560 connects computer 554 to a motion controller 562 which in actual practice is a servo motion card disposed inside the computer. Motion controller 562 is connected by leads 564, 566, 568, 570 and 572 with servo drives 574, 576, 578, 580 and 582, respectively. The servo drives 574, 576, 578 are connected to the servo motor 59 for the treadmill, servo motors 400 for the right knee drive and 342 for the right hip drive. The servo drives 580 and 582 are connected to servo motors 400' for the left knee drive and 342' for the left hip drive. It should be apparent that servo motors 400' and 342' correspond to the servo motors 400 and 342 respectively, but are supported by the leg actuator assembly on the opposite side of treadmill 38 to provide the left knee drive and the left hip drive, respectively. Leads 584, 586, 588, 590 and 592 provide feedback from servo drives 574, 576, 578, 580 and 582 to motion controller 562 and thence to computer 554. The hip and knee joint servos 576, 578, 580 and 582 are slaved to the treadmill servo 574 so that the various drive means operate in a coordinated manner to cause the legs of a patient to move in a desired gait. A control panel (not shown) may be connected to servo motors 59, 400, 342, 400' and 342' controlled thereby by suitable electrical cables (not shown), as would be apparent to a skilled artisan.

It should be apparent that each of the components described above for powered gait orthosis 30 may be made of metals, such as aluminum, steel, copper, titanium and the like, plastics, ceramics and equivalent materials, as would be apparent to a skilled artisan.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A powered gait orthosis comprising:

a treadmill for acting on the feet of a patient, said treadmill having opposite sides and being interconnected to a pair of spaced leg actuator assemblies;

a drive means for driving said treadmill;

the pair of leg actuator assemblies disposed adjacent to said opposite sides of said treadmill, each of said leg actuator assemblies including a support arm wherein at least one of said support arms is disposed substantially horizontally to said treadmill and is mounted for swinging movement about a generally vertical axis so as to swing outwardly away from said treadmill;

a first depending arm supported by said support arm for pivotal movement about a first generally horizontal axis;

a second depending arm supported by said first depending arm for pivotal movement about a second generally horizontal axis;

at least two depending arm drive means for moving said first and second depending arms about the pivot axes thereof;

first attachment means for attaching said first depending arm to a patient's leg just above the knee of the patient's leg;

second attachment means for attaching said second depending arm to a patient's leg adjacent the ankle of the patient's leg;

lifting means adapted to be secured to a lifting harness attached to a patient, said lifting means being supported by at least one guide tube and being generally vertically movable relative to said treadmill;

drive means for driving said lifting means generally vertically; and control means connected to said drive means for said treadmill and said drive means for said first and second depending arms to direct the drive means connected thereto to operate in a coordinated manner to cause the legs of a patient to move in a desired gait.

2. A powered gait orthosis according to claim 1, further comprising a lock mechanism for locking said support arm in an operative position, said lock mechanism including a block mounted adjacent said support arm and having a hole therein, a manually operable handle mounted to said support arm and reciprocating a bolt connected thereto between locked and unlocked positions, wherein in said locked position, said bolt is partially disposed within said hole, and in said unlocked position, said bolt is disposed out of said hole.

3. A powered gait orthosis according to claim 2, wherein said handle is mounted on a handle shaft disposed perpendicularly adjacent a longitudinal axis of said bolt, said handle shaft being operably connected to said bolt by an arm at a first end thereof, said arm having at least two recesses on a second end thereof, said lock mechanism further including a biased detent for snap fitting into one of said recesses, wherein in said locked position, said detent being disposed in one of said recesses, and in said unlocked position, said detent being disposed in another one of said recesses.

4. A powered gait orthosis according to claim 3, wherein said first end of said arm is bifurcated, said bolt including a pin extending substantially perpendicular to a longitudinal axis thereof, said pin being disposed in said bifurcated end of said arm.

5. A powered gait orthosis according to claim 1, further comprising drive means disposed in each of said leg actuator assemblies for providing generally vertical translation for each of said support arms, each of said drive means including a motor drivingly connected to a lead screw engaged with said support arm by a bushing to thereby convert rotational movement of said lead screw into said generally vertical translation of said support arm.

6. A powered gait orthosis according to claim 5, further comprising at least one guide tube disposed within each of said leg actuator assemblies and extending through holes in said support arm for providing a guide means for guiding said generally vertical translation of said support arm.

7. A powered gait orthosis according to claim 6, wherein said generally vertical translation of each of said support arms is limited by a limit switch mounted adjacent opposite ends of said lead screw.

8. A powered gait orthosis according to claim 1, wherein said drive means for moving said first depending arm of each leg actuator assembly comprises a motor supported by the support arm of the associated leg actuator assembly.

9. A powered gait orthosis according to claim 8, wherein said motor is interconnected by a belt with a pulley drivingly connected to said first depending arm.

10. A powered gait orthosis according to claim 9, wherein said pulley includes a plurality of outwardly projecting teeth matingly engaged with inwardly projecting teeth on said belt.

11. A powered gait orthosis according to claim 9, wherein said pulley is connected to a shaft defining said first generally horizontal axis by a key so as to transmit rotational motion to said first depending arm.

12. A powered gait orthosis according to claim 11, wherein said first depending arm is retained in position on said shaft by at least one lock nut.

13. A powered gait orthosis according to claim 9, further comprising a sensor for sensing a target mounted on said pulley, said sensor being adapted to sense the position of said target to thereby prevent over-travel of said first depending arm.

14. A powered gait orthosis according to claim 1, further comprising a mechanical stop including a first cross member mounted on said support arm for bearing against an edge surface on said first depending arm, thereby limiting pivoting of said first depending arm in a first direction; and a second cross member mounted on said first depending arm for bearing against an end surface of a member mounted to said first cross member, thereby limiting pivoting of said first depending arm in a second direction.

15. A powered gait orthosis according to claim 1, wherein said drive means for moving said second depending arm of each of said leg actuator assemblies comprises a motor supported by said first depending arm of the associated leg actuator assembly.

16. A powered gait orthosis according to claim 15, wherein said motor is interconnected by a belt with a pulley drivingly connected to said second depending arm.

17. A powered gait orthosis according to claim 16, wherein said pulley includes a plurality of outwardly projecting teeth matingly engaged with inwardly projecting teeth on said belt.

18. A powered gait orthosis according to claim 16, wherein said pulley is connected to a shaft defining said second generally horizontal axis by a key so as to transmit rotational motion to said second depending arm.

19. A powered gait orthosis according to claim 18, wherein said second depending arm is retained in position on said shaft by at least one lock nut.

20. A powered gait orthosis according to claim 16, further comprising a sensor for sensing a target mounted on said pulley, said sensor being adapted to sense the position of said target to thereby prevent over-travel of said second depending arm.

21. A powered gait orthosis according to claim 16, wherein said pulley includes a mechanical stop including at least two circumferentially spaced stop members adapted to engage a stop member mounted on said first depending arm and mounted on said pulley to prevent over-travel of said second depending arm.

22. A powered gait orthosis according to claim 1, wherein said first attachment means is supported by said first depending arm and is vertically adjustable relative thereto, said first depending arm including at least one guide rod, said first attachment means including a vertically movable portion slidably mounted on said guide rod, and a constant force counter balance spring connected to said vertically movable portion.

23. A powered gait orthosis according to claim 22, wherein said constant force counter balance spring is disposed on a shaft defining said first generally horizontal axis.

24. A powered gait orthosis according to claim 1, wherein said first attachment means includes an attachment cuff swiveled about a substantially horizontal axis and supported by a support member.

25. A powered gait orthosis according to claim 24, wherein said attachment cuff is horizontally adjustable relative to said support member and includes locking means for locking said first attachment cuff in a generally horizontal adjusted position relative to said support member.

26. A powered gait orthosis according to claim 22, further comprising a laterally extending arm connected to said vertically movable portion for mounting said attachment means.

27. A powered gait orthosis according to claim 1, wherein said second attachment means is supported by said second depending arm and is vertically adjustable relative thereto, said second depending arm including at least one guide rod, said second attachment means including a vertically movable portion slidably mounted on said guide rod, and a constant force counter balance spring connected to said vertically movable portion.

28. A powered gait orthosis according to claim 27, wherein said constant force counter balance spring is disposed on a shaft defining said second generally horizontal axis.

29. A powered gait orthosis according to claim 28, further comprising a cross member disposed within said first depending arm adjacent said constant force counter balance spring and a guide mounted on said cross member to prevent movement of said constant force counter balance spring along said second generally horizontal axis.

30. A powered gait orthosis according to claim 1, wherein said second attachment means includes an attachment cuff swiveled about a substantially horizontal axis and supported by a support member.

31. A powered gait orthosis according to claim 30, wherein said attachment cuff is horizontally adjustable relative to said support member and includes locking means for locking said attachment cuff in a generally horizontal adjusted position relative to said support member.

32. A powered gait orthosis according to claim 27, further comprising a laterally extending arm connected to said vertically movable portion for mounting said first attachment means.

33. A powered gait orthosis according to claim 1, wherein said lifting means includes a beam having an outer end for supporting a harness and disposed generally over a point lying substantially on longitudinal central axis of said treadmill.

34. A powered gait orthosis according to claim 33, wherein said outer end of said beam includes a harness support means rotatably adjustable about a generally vertical axis.

35. A powered gait orthosis according to claim 34, wherein said harness support means is rotationally connected to said beam by a swivel bolt having a shaft with a head.

36. A powered gait orthosis according to claim 35, wherein said shaft of said swivel bolt extends through a load cell and a load cell support, and said head of said swivel bolt is disposed above said load cell to impart a downward force on said load cell for weighing a patient.

37. A powered gait orthosis according to claim 34, wherein said harness support means includes at least one harness hanger having a plurality of holes for attachment of a lifting harness.

38. A powered gait orthosis according to claim 34, wherein a rotational orientation of said harness support means is fixedly adjustable at predetermined angular intervals relative to said beam by a locking roller engageable with a plurality of recesses in a lock plate connected to said harness support means to thereby retain said harness support means in a first rotational orientation when said locking roller is engaged with a recess and to allow said harness support means to freely rotate when said locking roller is disengaged from said recesses.

39. A powered gait orthosis according to claim 38, wherein said locking roller is retained in one said plurality of recesses by at least one lever affixed to an armature, said armature being biased by a compression spring to impart a retaining force on said locking roller, said armature being disposed in a solenoid affixed to said beam.

40. A powered gait orthosis according to claim 1, wherein said drive means for driving said lifting means is disposed in one of said leg actuator assemblies and includes a motor drivingly connected to a lead screw engaged with a screw nut mounted in a member interconnected with said lifting means, to thereby convert rotational movement of said lead screw into generally vertical translation of said lifting means.

41. A powered gait orthosis according to claim 40, further comprising at least one guide tube disposed within said one leg actuator assembly, said guide tube being mounted to said member and extending through bearings in holes in first and second generally horizontal support members for guiding said generally vertical translation of said lifting means.

42. A powered gait orthosis according to claim 1, further comprising a pair of hand holds extending generally toward one another, each of said hand holds being supported by one of said leg actuator assemblies.

43. A powered gait orthosis comprising:

a treadmill for acting on the feet of a patient, said treadmill having opposite sides;

drive means for driving said treadmill;

a pair of spaced leg actuator assemblies disposed at said opposite sides of the treadmill, said leg actuator assemblies each including a housing which supports a support arm;

adjusting means for moving said support arm generally vertically with respect to said housing;

a first depending arm having upper and lower ends, the upper end of said first depending arm being pivotally supported by said support arm wherein at least one of said support arms is disposed substantially horizontally to said treadmill and is mounted for swinging movement about a generally vertical axis so as to swing outwardly away from said treadmill;

a second depending arm having upper and lower ends, the upper end of said second depending arm being pivotally supported by the lower end of said first depending arm;

first depending arm drive means for moving said first depending arm about the pivot axis thereof;

second depending arm drive means for moving said second depending arm about the pivot axis thereof;

first attachment means adjacent the lower end of said first depending arm for attaching said first depending arm to a patient's leg just above the knee of the patent's leg;

second attachment means adjacent the lower end of said second depending arm for attaching said second depending arm to a patient's leg adjacent the ankle of the patient's leg;

lifting means adapted to be secured to a lifting harness attached to a patient, said lifting means being supported by one of said housings and being generally vertically movable relative thereto;

drive means for driving said lifting means generally vertically; and control means connected to the drive means for said treadmill and the drive means for said first and second depending arms to direct the various drive means connected thereto to operate in a coordinated manner to cause the legs of a patient to move in a desired gait.

44. A powered gait orthosis according to claim 43, said adjusting means including a motor drivingly connected to a lead screw engaged with said support arm by a bushing to thereby convert rotational movement of said lead screw into said generally vertical translation of said support arm.

45. A powered gait orthosis according to claim 43, wherein said first depending arm drive means comprises a motor supported by the support arm of the associated housing, said motor being interconnected by a belt with a pulley drivingly connected to said first depending arm.

46. A powered gait orthosis according to claim 43, wherein said second depending arm drive means comprises a motor supported by said first depending arm of the associated housing, said motor being interconnected by a belt with a pulley drivingly connected to said second depending arm.

47. A powered gait orthosis according to claim 43, wherein said first attachment means is supported by said first depending arm and is vertically adjustable relative thereto, said first depending arm including at least one guide rod, said first attachment means including a vertically movable portion slidably mounted on said guide rod, and a constant force counter balance spring connected to said vertically movable portion.

48. A powered gait orthosis according to claim 43, wherein said second attachment means is supported by said second depending arm and is vertically adjustable relative thereto, said second depending arm including at least one guide rod, said second attachment means including a vertically movable portion slidably mounted on said guide rod, and a constant force counter balance spring connected to said vertically movable portion.

49. A powered gait orthosis according to claim 43, wherein said lifting means includes a beam having an outer end for supporting a harness and disposed generally over a point lying substantially on longitudinal central axis of said treadmill.

50. A powered gait orthosis according to claim 43, wherein said drive means for driving said lifting means is disposed in one of said housings and includes a motor drivingly connected to a lead screw engaged with a screw nut mounted in a member interconnected with said lifting means, to thereby convert rotational movement of said lead screw into generally vertical translation of said lifting means.

51. A method of simulating a normal walking pattern for a patient, said method comprising the steps of:

providing a patient with a harness;

providing a powered lifting device including a harness attaching portion above a powered treadmill, said powered lifting device being vertically moveable with respect to said treadmill;

moving the patient into position directly beneath said attaching portion and lowering said lifting device to facilitate attaching the harness to said harness attaching portion of the lifting device;

attaching the harness to the harness attaching portion of the lifting device;

lifting the patient and lowering the patient onto the powered treadmill by raising and lowering, respectively, said powered lifting device;

providing a powered leg actuator assembly including a first and a second powered leg actuator portions at one side of the treadmill, each of said first and second powered leg actuator portions having a separate drive means;

attaching the first leg actuator portion to the ankle of one leg of the patient;

attaching the second leg actuator portion at a point just above the knee of the one leg of the patient;

providing a control means in communication with the treadmill and the first and second powered leg actuator portions to separately and independently control the speed of movement of the treadmill, the first leg actuator portion and the second leg actuator portion, to coordinate the movement of the patient's leg to cause the leg to move in a desired gait; and providing a sensor to sense over-travel of the first leg-actuator portion to stop the drive means for the first leg actuator portion to prevent patient injury.

52. A method according to claim 51, further comprising the step of varying the height of said first and second leg actuator portions relative to the treadmill in accordance with the height of a patient.

53. A method according to claim 51, further comprising the step of providing hand holds which are grasped by the patient while the patient's leg is being moved to stabilize the patient's torso.

54. A method according to claim 51, further comprising the step of sensing over-travel of the second leg actuator portion to stop the drive means for the second leg actuator portion to prevent patient injury.

55. A method according to claim 51, further comprising the step of rotating said leg actuator assembly about a generally vertical axis to a position substantially transverse and away from said treadmill so as to facilitate ingress or egress of a patient.

56. A method according to claim 51, further comprising the steps of:

rotating said leg actuator assembly into an operative position substantially parallel said treadmill, so as to permit attachment of said first and second leg actuator portions to the leg of the patient; and locking said leg actuator assembly into said operative position.

57. A method of simulating a normal walking pattern for a patient, said method comprising the steps of:

providing a patient with a harness;

providing a powered lifting device including a harness attaching portion above a powered treadmill, said powered lifting device being vertically moveable with respect to said treadmill;

moving the patient into position directly beneath said attaching portion and lowering said lifting device to facilitate attaching the harness to said harness attaching portion of the lifting device;

attaching the harness to the harness attaching portion of the lifting device;

lifting the patient and lowering the patient onto the powered treadmill by raising and lowering, respectively, said powered lifting device;

providing a pair of powered leg actuator assemblies at opposite sides of the treadmill, each of said leg actuator assemblies including a first and a second powered leg actuator portions, each of said first and second powered leg actuator portions having a separate drive means;

attaching the first leg actuator portion at one side of the treadmill to the ankle of one leg of the patient;

attaching the second leg actuator portion at said one side of the treadmill at a point just above the knee of the one leg of the patient;

attaching the second leg actuator portion at the opposite side of the treadmill to the ankle of the other leg of the patient;

attaching the second leg actuator portion at the opposite side of the treadmill at a point just above the knee of the other leg of the patient; and providing a control means in communication with the treadmill and each of the first and second powered leg actuator portions to separately and independently control the speed of movement of the treadmill, each of the first leg actuator portions and each of the second leg actuator portions, to coordinate the movement of the patient's legs to cause the legs to move in a desired gait; and providing a sensor to sense over-travel of the first leg-actuator portion of each of the leg actuator assemblies to stop the drive means for the associated first leg actuator portion to prevent patient injury.

58. A method according to claim 57, further comprising the step of varying the height of said first and second leg actuator portions of at least one of the leg actuator assemblies relative to the treadmill in accordance with the height of a patient.

59. A method according to claim 57, further comprising the step of providing hand holds which are grasped by the patient while the patient's legs are being moved to stabilize the patient's torso.

60. A method according to claim 57, further comprising the step of sensing over-travel of the second leg actuator portion of each of the leg actuator assemblies to stop the drive means for the associated second leg actuator portion to prevent patient injury.

61. A method according to claim 57, further comprising the step of rotating said first and second leg actuator assemblies about a generally vertical axis to a position substantially transverse and away from said treadmill so as to facilitate ingress or egress of a patient.

62. A method according to claim 57, further comprising the steps of: rotating said first and second leg actuator assemblies into an operative position substantially parallel said treadmill, so as to permit attachment of said first and second leg actuator portions to the legs of the patient; and locking said first and second leg actuator assemblies into said operative position.

* * * * *

UNITED STATES PATENT AND TRADEMARK OFFICE

CERTIFICATE OF CORRECTION

PATENT NO. : 7,041,069 B2
APPLICATION NO. : 10/200453
DATED : May 9, 2006
INVENTOR(S) : R. Gary West It is certified that error appears in the above-identified patent and that said Letters Patent is hereby corrected as shown below:

On the Title Page:

On the cover page of the issued patent, block 73, the name of the Assignee is listed as "Health South" (two words) but should be listed as "HealthSouth" (one word).

Signed and Sealed this

Twenty-fifth Day of July, 2006

JON W. DUDAS
*Director of the United States Patent and Trademark Office*